US006940988B1

(12) United States Patent
Shennib et al.

(10) Patent No.: US 6,940,988 B1
(45) Date of Patent: Sep. 6, 2005

(54) SEMI-PERMANENT CANAL HEARING DEVICE

(75) Inventors: Adnan Shennib, Fremont, CA (US); Richard C. Urso, Redwood City, CA (US); Diep H. Ngo, San Jose, CA (US)

(73) Assignee: InSound Medical, Inc., Newark, CA (US)

( * ) Notice: Subject to any disclaimer, the term of this patent is extended or adjusted under 35 U.S.C. 154(b) by 0 days.

(21) Appl. No.: 09/199,669

(22) Filed: Nov. 25, 1998

(51) Int. Cl.[7] ..... H04R 25/00

(52) U.S. Cl. ..... 381/322; 381/323; 381/324; 381/325; 381/328; 181/130; 181/135

(58) Field of Search ..... 381/322, 323, 381/324, 312, 325, 315, 328, 380, 329, 313; 181/135, 130; 607/55–57; 600/25, 559

(56) References Cited

U.S. PATENT DOCUMENTS

| | | | | |
|---|---|---|---|---|
| 3,061,689 A | | 10/1962 | McCarrell et al. | 179/107 |
| RE26,258 E | | 8/1967 | Martin | 179/107 |
| 3,414,685 A | | 12/1968 | Geib et al. | 179/107 |
| 3,527,901 A | | 9/1970 | Geib | 179/107 |
| 3,594,514 A | | 7/1971 | Wingrove | |
| 3,764,748 A | | 10/1973 | Branch et al. | |
| 3,783,201 A | | 1/1974 | Weiss et al. | 179/107 E |
| 3,865,998 A | | 2/1975 | Weiss et al. | 179/107 E |
| 3,870,832 A | | 3/1975 | Fredrickson | |
| 3,882,285 A | | 5/1975 | Nunley et al. | |
| 4,539,440 A | * | 9/1985 | Sciarra | |
| 4,606,329 A | | 8/1986 | Hough | |
| 4,607,720 A | | 8/1986 | Hardt | 181/135 |
| 4,628,907 A | | 12/1986 | Epley | |
| 4,639,556 A | | 1/1987 | Hartl et al. | 381/68.6 |
| 4,680,799 A | | 7/1987 | Henneberger | 381/68.6 |
| 4,756,312 A | | 7/1988 | Epley | |
| 4,776,322 A | | 10/1988 | Hough et al. | |
| 4,817,607 A | | 4/1989 | Tatge | |
| 4,830,139 A | | 5/1989 | Cirillo | 181/130 |
| 4,840,178 A | | 6/1989 | Heide et al. | |
| 4,870,688 A | | 9/1989 | Voroba et al. | 381/60 |

(Continued)

OTHER PUBLICATIONS

US 5,730,699, 3/1998, Adams et al. (withdrawn)

Chasin, Marshall, *CIC Handbook,* Singular Publishing Group, Inc. (1997), pp. 12–14, 17–18, 27–28, 44, 56–58, and 65–66.

(Continued)

*Primary Examiner*—Huyen Le
*Assistant Examiner*—Dionne Harvey
(74) *Attorney, Agent, or Firm*—Townsend & Townsend & Crew LLP

(57) ABSTRACT

A semi-permanent hearing device is disclosed which is adapted to be completely positioned within the ear canal of an individual for long-term use. The device comprises a sealing retainer substantially positioned in the bony region of the ear canal and a core assembly including a receiver assembly coaxially positioned within the sealing retainer. When the device is inserted into its completely-in-the-canal position, the core assembly extends from the sealing retainer to the cartilaginous region of the ear canal in a non-occluding fashion, thereby minimizing interference with hair and earwax production present in the cartilaginous region. In a preferred embodiment of the device, the core assembly comprises a battery assembly conforming substantially to the shape and dimensions of the battery enclosed within the assembly. A connector in the form of a thin ribbon film provides electrical and flexible mechanical connectivity between the receiver assembly, the centrally positioned battery assembly, and a microphone assembly positioned in the cartilaginous region. The disclosed hearing device is characterized by the absence of a unitary enclosure or a main housing, in contrast to the enclosure or housing which typically encompasses the battery along with other components in prior art hearing device designs.

49 Claims, 12 Drawing Sheets

U.S. PATENT DOCUMENTS

| | | | | | |
|---|---|---|---|---|---|
| 4,880,076 | A | | 11/1989 | Ahlberg et al. | 181/130 |
| 4,937,876 | A | | 6/1990 | Biermans | 381/68.6 |
| 4,957,478 | A | | 9/1990 | Maniglia | |
| 5,002,151 | A | | 3/1991 | Oliveira et al. | 181/130 |
| 5,015,224 | A | | 5/1991 | Maniglia | |
| 5,015,225 | A | | 5/1991 | Hough et al. | |
| 5,163,957 | A | | 11/1992 | Sadé et al. | |
| 5,220,918 | A | | 6/1993 | Heide et al. | |
| 5,259,032 | A | | 11/1993 | Perkins et al. | |
| 5,282,858 | A | | 2/1994 | Bisch et al. | |
| 5,338,287 | A | | 8/1994 | Miller et al. | |
| 5,390,254 | A | | 2/1995 | Adelman | 381/68 |
| 5,425,104 | A | | 6/1995 | Shennib | |
| 5,456,654 | A | | 10/1995 | Ball | |
| 5,531,787 | A | | 7/1996 | Lesinski et al. | |
| 5,554,096 | A | | 9/1996 | Ball | |
| 5,624,376 | A | | 4/1997 | Ball et al. | |
| 5,654,530 | A | | 8/1997 | Sauer et al. | 181/130 |
| 5,659,621 | A | * | 8/1997 | Newton | |
| 5,682,020 | A | | 10/1997 | Oliveira | |
| 5,701,348 | A | | 12/1997 | Shennib et al. | 381/68.6 |
| 5,742,692 | A | * | 4/1998 | Garcia | |
| 5,833,626 | A | | 11/1998 | Leysieffer | |
| 6,058,198 | A | * | 5/2000 | Aceti | |
| 6,208,741 | B1 | * | 3/2001 | Shennib et al. | 381/323 |
| 6,212,283 | B1 | * | 4/2001 | Fletcher | |
| 6,408,081 | B1 | | 6/2002 | Boesen | |
| 6,595,796 | B1 | * | 7/2003 | Koegel | |
| 6,620,110 | B2 | | 9/2003 | Schmid | |
| 6,643,378 | B2 | | 11/2003 | Schumaier | |
| 6,648,813 | B2 | | 11/2003 | Zilberman et al. | |
| 6,658,126 | B1 | | 12/2003 | Stern | |

OTHER PUBLICATIONS

Oliviera, Robert J., and Navarro, Richard, "The Wax Problem: Two New Approaches," *The Hearing Journal* (Aug. 1993) vol. 46, No. 8, pp. 41–46.

B. Ballachanda, The Human Ear Canal, p. 195.

M. Valente, Strategies for Selecting and Verifying Hearing Aid Fittings (1994), pp. 255–256.

M. Chasin, CIC Handbook, pp. 5, 9–14, 27–28, 44, 56–58.

Widex User's Instructions SENSO CIC and Mini Canal, pp. 2–27.

Siemens General Information for Hearing Aid Users, pp. 1–14.

R. Oliveira et al., The Wax Problem: Two New Approaches, Hearing J. (v.46, n.8, 1993) pp. 42, 44–46, 48.

* cited by examiner

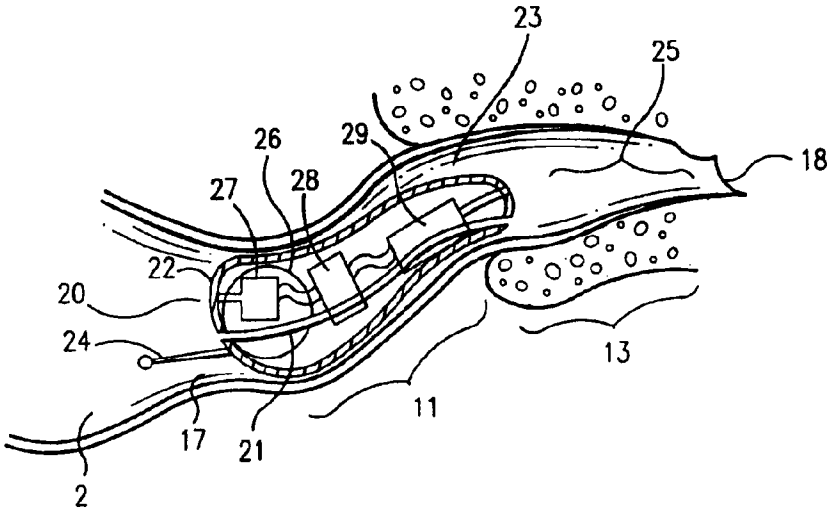
FIG. 3
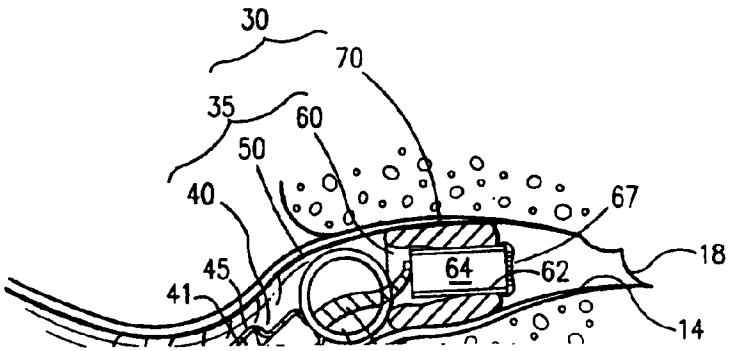

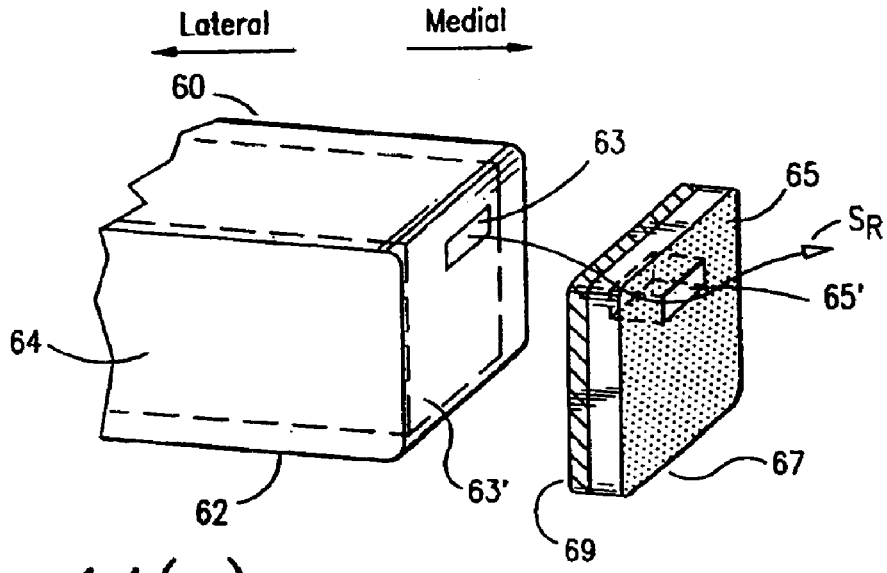
FIG. 14(a)
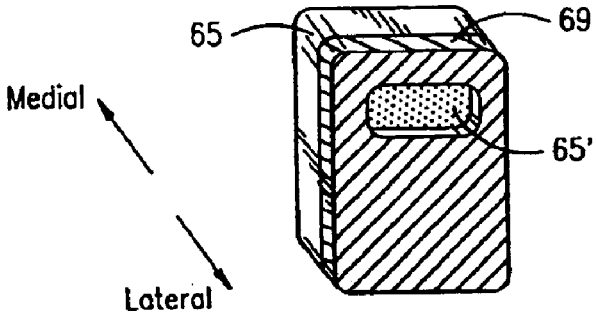
FIG. 14(b)
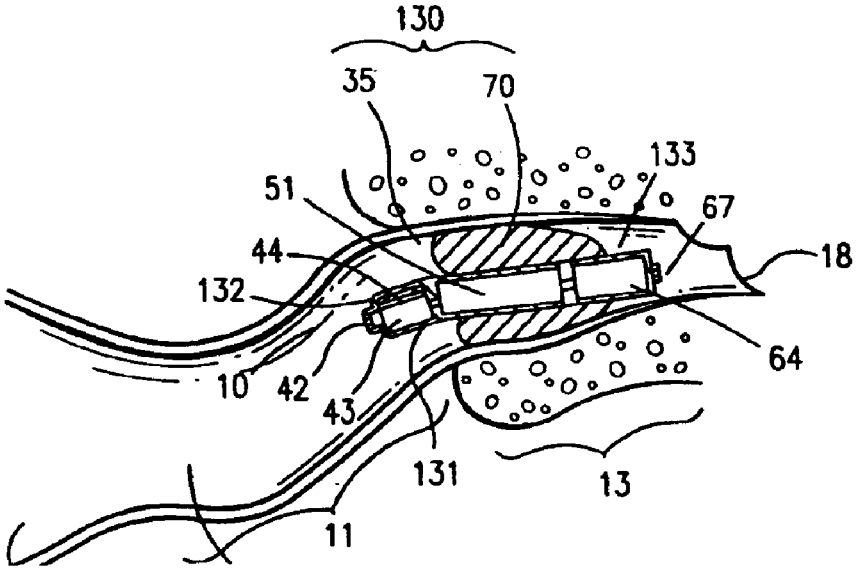

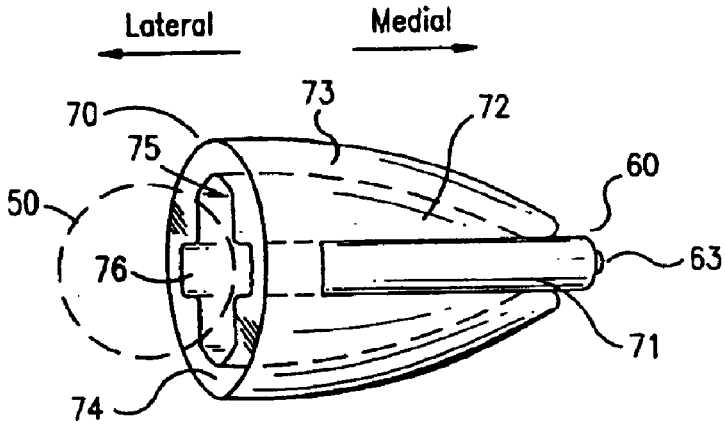
FIG. 16(a)
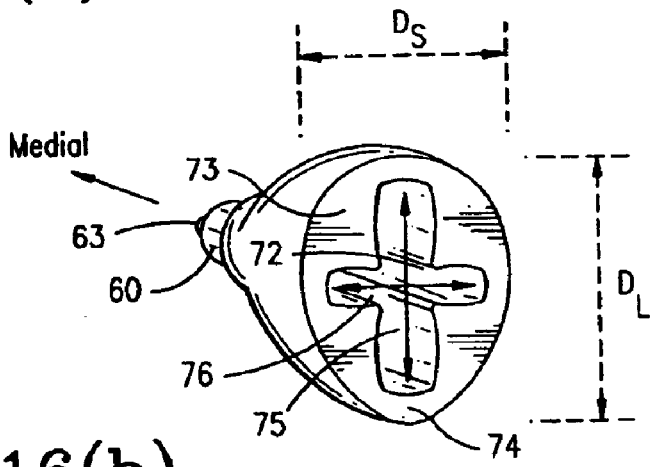
FIG. 16(b)
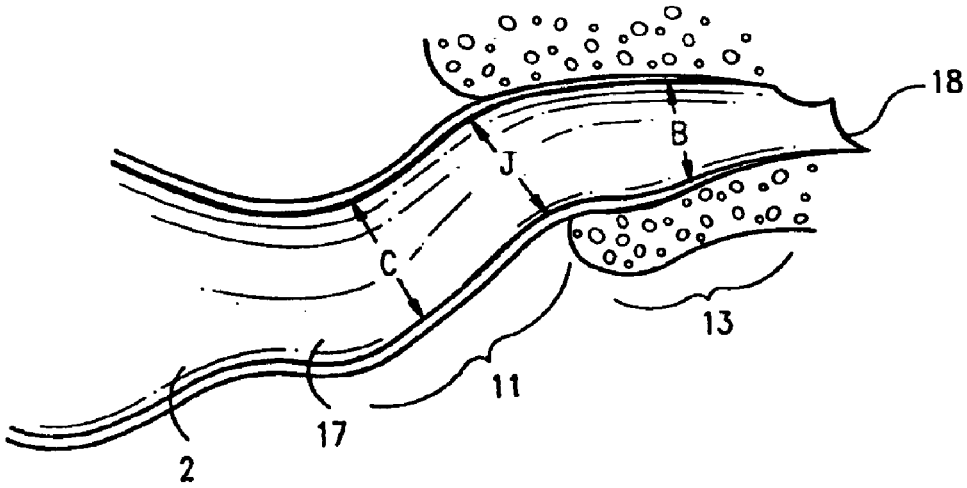

SEMI-PERMANENT CANAL HEARING DEVICE

CROSS-REFERENCE TO RELATED APPLICATIONS

This application is related to co-pending patent applications Ser. No. 09/181,533, filed Oct. 28, 1998, titled "Remote Magnetic Activation of Hearing Devices" (referred to herein as the "'533 application"); and Ser. No. 09/190,764, filed Nov. 12, 1998, titled "Battery Enclosure for Canal Hearing Devices", now U.S. Pat. No. 6,208,741, issued Mar. 27, 2001 (referred to herein as the "'741 patent").

BACKGROUND OF THE INVENTION a. Technical Field

The present invention relates to hearing devices, and, more particularly, to hearing devices that are semi-permanently positioned in the ear canal for improved energy efficiency, sound fidelity, and inconspicuous wear.

b. Description of the Prior Art (1) Brief Description of Ear Canal Anatomy and Physiology The external acoustic meatus (ear canal) is generally narrow and tortuous as shown in the coronal view in FIG. 1. The ear canal 10 is approximately 23–29 millimeters (mm) long from the canal aperture 17 to the tympanic membrane 18 (eardrum). The lateral part, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. Hair 12 is primarily present in the cartilaginous region. The medial part, a bony region 13 proximal to the tympanic membrane, is rigid due to the underlying bony tissue. The skin 14 in the bony region 13 is thin (relative to the skin 16 in the cartilaginous region) and is sensitive to touch or pressure. A characteristic bend 15 roughly occurring at the bony-cartilaginous junction 19 separates the cartilaginous and bony regions 11 and 13, respectively. The magnitude of this bend varies significantly among individuals.

A cross-sectional view of the typical ear canal 10 (FIG. 2) reveals generally an oval shape with a long diameter $D_L$ in the vertical axis and a short diameter $D_S$ in the horizontal axis. Canal dimensions vary significantly among individuals as shown below in the section titled Experiment-A. The long/short ratio ($D_L/D_S$) ranges from 1:1 to 2:1. The diameter ranges from as little as 4 mm ($D_S$ in the bony region 13 in small canals) to as much as 12 mm ($D_L$ in the cartilaginous region 11 in large canals).

Physiological debris 4 in the ear canal is primarily produced in the cartilaginous region 11, and includes cerumen (earwax), sweat, and oils produced by the various glands underneath the skin in the lateral portion of the cartilaginous region. Cerumen is naturally extruded from the ear canal by the process of lateral epithelial cell migration (see, e.g., Ballachanda, *The Human Ear Canal*, Singular Publishing, 1950, pp. 195). There is no cerumen production or hair 12 in the bony part of the ear canal. The ear canal 10 terminates medially with the tympanic membrane 18. Externally and lateral to the ear canal are the concha cavity 2 and the auricle 3.

Several types of hearing losses affect millions of individuals. Hearing loss naturally occurs beginning at higher frequencies (4000 Hz and above) and increasingly spreads to lower frequencies with age.

(2) The Limitations of Conventional Canal Hearing Devices

Conventional hearing devices that fit in the ear of individuals generally fall into one of 4 categories as classified by the hearing aid industry: (1) the Behind-The-Ear (BTE) type which, as the designation indicates, is worn behind the ear and is attached to an ear mold which fit mostly in the concha; (2) the In-The-Ear (ITE) type which fits largely in the auricle and concha areas, extending minimally into the ear canal; (3) the In-The-canal (ITC) type which fits largely in the concha area and extends into the ear canal (see, e.g., Valente M., *Strategies for Selecting and Verifying Hearing Aid Fittings*, Thieme Medical Publishing, pp. 255–256, 1994), and (4) the Completely-In-the-Canal (CIC) type which fits completely within the ear canal past the aperture (see, e.g., Chasin, M. *CIC Handbook*, Singular Publishing, 1997 (referred to hereinafter as "Chasin"), p. 5).

The continuous trend for the miniaturization of hearing aids is fueled by the demand for invisible hearing products in order to alleviate the social stigma associating hearing loss with aging and disability. In addition to the cosmetic advantage of a CIC device 20 (FIG. 3), there are actual acoustic benefits resulting from the deep placement of the device within the ear canal. These benefits include improved high frequency response, less distortion, reduction of feedback and improved telephone use (e.g., Chasin, pp. 10–11).

However, even with these significant advances leading to the advent of CIC technology, there remain a number of fundamental limitations associated with the underlying design and configurations of conventional CIC technology. They include: (a) frequency device handling, (b) acoustic feedback, (c) custom manufacturing & impression taking, (d) limited energy efficiency, (e) size limitation due to space inefficiency of enclosure, and (f) occlusion related problems. These limitations are discussed in more detail below.

(a) Frequent device handling:

Conventional CIC devices require frequent insertion and removal from the ear canal. Manufacturers often recommend daily removal for cleaning and maintenance of the CIC device (see, e.g., *Users's Instructions, SENSO CIC and Mini Canal*, Widex Hearing Aid Co. February 97, pp. 11, 16; and *General Information for Hearing aid Users*, Siemens Hearing Instruments, Inc. March 98, p. 8). Frequent removal of conventional CICs is also required for relieving the ear from the pressures of the device occluding the cartilaginous region. Furthermore, CIC hearing aid removal is also required in order to replace its battery, typically lasting from 1 to 2 weeks. The manual dexterity required to handle a CIC hearing device frequently poses a serious challenge to the many hearing impaired persons represented by the elderly. These individuals typically suffer from arthritis, tremors, or other neurologic problems that limit their ability to handle a miniature hearing aid.

(b) Acoustic feedback:

Acoustic feedback occurs when a portion of the sound output, typically from a receiver (speaker), leaks to the input of a sound system such as a microphone of a hearing aid. This leakage often causes a sustained oscillation, which is manifested by "whistling" or "squealing". Feedback is not only annoying to hearing aid users but also interferes with their communication. Feedback is typically alleviated by occluding (sealing) the ear canal tightly, particularly at the cartilaginous region 11, as illustrated with the CIC hearing device in FIG. 3.

(c) Custom manufacturing & impression taking:

Conventional CIC devices are custom made according to an impression taken from the ear of the individual. The device housing 22 (FIG. 3), known as a shell, is custom fabricated according to the impression, to accurately assume the shape of the individual ear canal. Customizing a conventional CIC is required in order to minimize feedback and to improve comfort of wear. But custom manufacturing is time consuming and results in considerable cost overhead for the manufacturer, ultimately reflected in the price of the CIC device to the consumer (user). Furthermore, impression taking is often uncomfortable for the user.

(d) Limited energy efficiency:

The efficiency of a hearing device is generally inversely proportional to the distance or residual volume 25 (FIG. 3) between the receiver (speaker) end 23 and the tympanic membrane 18, the closer the receiver is to the tympanic membrane, the less air mass there is to vibrate, and thus, less energy is required. However, due to concerns related to discomfort and difficulty of insertion, CIC products are typically tapered at their medial end 23 (e.g., Chasin, pp. 9–10) and relatively shallow in their placement in order to avoid substantial contact with the bony portion of the ear canal as shown in FIG. 3.

(e) Size limitation due to space inefficiency of enclosure:

Since a conventional CIC is frequently handled by a wearer, the enclosure 22 (FIG. 3) must be made durably thick in order to protect the components contained within (battery 26, microphone 27, amplifier 28 and receiver 29). Therefore, a shell, or main housing, is typically made of rigid material such as plastic (e.g. acrylic). Typical thickness for this housing or enclosure of CIC devices is 0.5 to 0.7 mm, which adds considerable dimensions to the conventional CIC. Furthermore, conventional shells enclose the battery along with other components, which makes the overall housing large. This space inefficiency renders the device unsuitable for many individuals with small or highly contoured ear canals who would not be able to comfortably tolerate insertion and wear of a CIC device deep in the ear canal.

(f) Occlusion related problems:

(i) Discomfort, irritation and even pain may occur due to canal abrasion caused by frequent insertion and removal of a CIC hearing aid. A removal strand 24 (FIG. 3) is generally provided with CIC devices to assist the wearer in the daily removal process. Due to the resultant discomfort and abrasion, hearing devices are frequently returned to the manufacture for improvement of the custom fit and comfort (e.g., Chasin, p. 44). "The long term effects of the hearing aid are generally known, and consist of atrophy of the skin and a gradual remodeling of the bony canal. Chronic pressure on the skin lining the ear canal causes a thinning of this layer, possibly with some loss of skin appendages" (Chasin, p. 58).

(ii) Moisture produced in the cartilaginous ear canal causes damage to the ear canal and the hearing device therein. "The humidity in the occluded portion of the canal increases rapidly. This is worse during hot and humid weather, following exercise" (Chasin, pp. 57–58). It is often recommended that the CIC device should be removed from the ear canal daily to reduce the damaging effects of moisture in the canal.

(iii) Cerumen impaction (blockage of the ear canal by earwax) may occur when cerumen, produced in the cartilaginous region, is pushed and accumulated deeper in the bony region of ear canal by the frequent insertion of a CIC hearing device (e.g., Chasin, p. 27, pp. 56–57). Cerumen can also build up on the receiver of the hearing device causing frequent malfunction. Cerumen contamination due to frequent insertion is probably the most common factor leading to hearing aid damage and repair (see, e.g., Oliveira, et al, *The Wax Problem: Two New Approaches*, The Hearing Journal, Vol. 46, No. 8).

(iv) The occlusion effect, a common acoustic problem attributable to occlusion of the ear canal by the hearing device, is manifested by the perception of the user's (wearer's) own voice ("self-voice") being loud and unnatural compared to that with an open (unoccluded) ear canal. This phenomenon is sometimes referred to as the "barrel effect", since it resembles the experience of talking into a barrel. The occlusion effect, which may be experienced by plugging the ears with fingers while talking, is generally related to self-voice resonating within the ear canal. For hearing aid users, the occlusion effect is inversely proportional to the residual volume 25 (FIG. 3) of air between the occluding hearing device and the tympanic membrane. Therefore, the occlusion effect is considerably alleviated by deeper placement of the device in the ear canal. Incorporating a vent 21 across the CIC hearing device 20 can also alleviate this effect.

The above limitations in conventional CIC devices are highly interrelated. For example, when a CIC is worn in the ear canal, movements in the cartilaginous region "can lead to slit leaks that lead to feedback, discomfort, the occlusion effect, and 'pushing' of the aid from the ear" (Chasin, pp. 12–14). The relationship between the limitations is often adverse. For example, occluding the ear canal tightly is desired on one hand to prevent feedback. On the other hand, however, tight occlusion leads to various adverse side effects as mentioned above. Attempts to alleviate the occlusion effect by a vent 21 provide an opportunistic pathway for leakage and feedback. For this reason, the vent 21 diameter is typically limited in CIC devices to 0.6–0.8 mm (e.g., Chasin, pp. 27–28).

(3) Review of state-of-the-art in related hearing device technology

Ahlberg et al and Oliviera et al in U.S. Pat. Nos. (USPNs) 4,880,076 and 5,002,151 respectively, disclose a compressible polymeric foam assembly attached to an earpiece of a hearing device. The compressible foam assembly (FIG. 1 of both Ahlberg and Oliviera) is inserted in to the ear canal to couple sound and seal acoustically therein. The foam seal is attached serially to the earpiece, which adds a considerable dimension to overall length of the hearing device. Therefore, the application of such compressible foam assembly is limited to BTE and ITE devices which have housings positioned external to the ear canal.

Cirillo in U.S. Pat. No. 4,830,139 discloses means for holding a speaker mold (16 in Cirillo's FIG. 1) in the ear canal via a sealant made of flexible gelatinous water-soluble material. The mold is attached to a wire (18) extending to the outside of the ear canal, and therefore, Cirillo's proposal is presumably also for hearing devices that are positioned outside the ear canal. It does not deal with devices that are completely positioned in the ear canal. Furthermore, since the sealant is water-soluble, it can also be assumed to be suitable only for short-term use as it will deteriorate with moisture exposure (e.g., as will occur when the wearer is taking a shower or is caught in the rain).

Sauer et al in U.S. Pat. No. 5,654,530 disclose an insert associated with an ITE device (Sauer's FIG. 1) or a BTE device (Sauer's FIG. 2). The insert is stated to be a "sealing and mounting element" made of "soft elastic material having slotted outer circumference divided into a plurality of fan-like circumferential segments". The sealing element is positioned at the lateral portion of the ear canal as shown in Sauer's figures. According to the patent, the insert is for ITEs and BTEs only, not for inconspicuous hearing devices that are deeply and completely inserted in the ear canal. The insert as disclosed is used in the cartilaginous area, thus occluding the ear canal in the region of hair, cerumen and sweat production. Clearly, long term use (without daily removal) will interfere in the natural production of physiologic debris.

Garcia et al. in U.S. Pat. No. 5,742,692 disclose a hearing device (10 in Garcia's FIG. 1) attached to a flexible seal 30 which is fitted in the bony region of the ear canal. The device 10 comprises hearing aid components (i.e., microphone 12, receiver 15 and battery 16, etc., as shown by Garcia) which are contained within a single "unitary" housing 20. The device 10 is not likely to fit deeply and comfortably in many small and contoured canals due to the space inefficiency associated with the unitary housing 20. In addition to the size disadvantage, the device 10 occludes the ear canal in the cartilaginous region as shown in Garcia's FIG. 2.

Henneberger and Biermans in U.S. Pat. Nos. 4,680,799 and 4,937,876, respectively, also disclose hearing aids with conventional housings, which occlude the ear canal and comprise a unitary enclosure for microphone, battery and receiver components therein.

Weiss et al. in U.S. Pat. Nos. 3,783,201 and 3,865,998 disclose an alternate hearing device configuration which fits partially in the ear canal (FIG. 1 in both the Weiss '201 and '998 patents) with a separate microphone 14 and receiver 18. The main housing, enclosing battery and amplifier, is designed to fit in the concha area outside the ear canal as shown. The microphone 14 is positioned in the pinna completely outside the ear canal. The device is clearly visible to the casual observer.

Geib in U.S. Pat. No. 3,527,901 discloses a hearing device with housing made of soft resilient material, which encloses the entire body of the device. This approach eliminates conventional rigid enclosures, and is presumably more comfortable to wear. However, the unitary flexible enclosure provides no improvement in space efficiency and also poses serious concerns regarding the reliability of interconnects, and of the device in general, during frequent handling. The disclosed hearing device was not designed to fit entirely in the ear canal, Geib stating that "the hearing aid makes a much better fit within the concha and ear canal of the user thereby providing a more effective seal and reducing the problems of direct acoustic feedback" (col 2, lines 40–43).

Hardt in U.S. Pat. No. 4,607,720 discloses a hearing device which is mass-producible with a soft sealing plug that is serially attached to the receiver. Although the problem of custom manufacturing is addressed, the unitary enclosure (containing major hearing aid components; battery, microphone and receiver) is, as with other prior art proposals, space-inefficient for deep canal fittings.

Voroba et al in U.S. Pat. No. 4,870,688 also disclose a mass-producible hearing aid, which includes a solid shell core (20 in Veroba's FIGS. 1 and 2) with a flexible covering 30 affixed to its exterior. Similarly, the rigid core represents a unitary enclosure for all major hearing aid components, and thus, is space-inefficient for deep canal fittings.

Hartl et al. in U.S. Pat. No. 4,639,556 disclose a hearing aid with a flexible printed circuit board attached to a face-plate. The flexible circuit board and major hearing aid components are also enclosed in a unitary housing (1 in Hartl's FIG. 1). Similarly, this leads to a space-inefficient design for deep canal fittings.

McCarrel et al, Martin, Geib et al, and Adelman, in U.S. Pat. Nos. 3,061,689, RE 26,258, 3,414,685 and 5,390,254, respectively, disclose miniature hearing devices with a receiver portion flexibly separate from a main part. The receiver portion insertable into the ear canal with the main part occupying the concha (McCarrel's FIG. 2, Geib's FIG. 10, and Adelman's FIG. 3B). This placement facilitates access to the device for insertion and removal. In each of these disclosures, the aforementioned main part contains all the major components of the hearing device, including among others the battery, amplifier and microphone, except the receiver. Therefore, this main part is not sufficiently space-efficient to fit past the aperture of the ear canal for most individuals.

Shennib et al in U.S. Pat. No. 5,701,348 disclose an articulated hearing device with flexibly connecting modules, stating that "the main module 12 includes all of the typical components found in hearing devices, except for the receiver" (col. 6, lines 64–66). The main module includes a battery 16, a battery compartment 15, circuit 17 (amplifier) and microphone 14. Because if its articulated design and assorted soft acoustic seal 43, the hearing device disclosed by Shennib is suitable to fit a variety of ear canals without resorting to custom manufacturing, and thus can be mass-producible as disclosed. Although a CIC configuration is disclosed (see Shennib's FIG. 23), the depth of insertion, particularly for small and contoured ear canals, is severely limited by the design of the main module 12 which contains the power source (battery) along with other major components (e.g., the microphone). Furthermore, in each of its disclosed configurations, the device substantially occludes the ear canal in the cartilaginous region, which would interfere with hair and the natural production of physiologic debris. In addition, the disclosed CIC configuration is designed for insertion and removal by a wearer with good dexterity (col. 11, lines 18–20). Therefore, the disclosed CIC device would be unsuitable for continuous long-term use in the ear canal, particularly for persons lacking such dexterity.

It is the principal objective of the present invention to provide a highly space-efficient hearing device, which is suitable to be completely positioned in the ear canal.

Another objective is to provide a design for a hearing device which is mass-producible, and which requires neither custom manufacture nor the taking of individual ear canal impressions.

A further objective of the invention is to provide a hearing device which occludingly seals the ear canal in the bony region, but not at the cartilaginous region, and thus does not interfere with hair and the natural production and elimination of physiologic debris in the ear canal.

Yet another objective is to provide a semi-permanent hearing device which is inserted by a physician, or by other professionals under the supervision of a physician, for long-term use in the ear canal.

Semi-permanent, or alternatively long-term use, is defined herein as continuous placement and use of the hearing device within the ear canal without any removal, daily or otherwise, for at least a month.

SUMMARY OF THE INVENTION

The invention provides a semi-permanent hearing device which is completely positioned within the ear canal of an individual for long-term use. The device comprises a sealing retainer substantially positioned in the bony region of the ear canal and a core assembly comprising a receiver assembly coaxially positioned within the sealing retainer.

The core assembly extends from the sealing retainer to the cartilaginous region in a non-occluding fashion, thus minimizing interference with hair and earwax production present in the cartilaginous part of the ear canal. In a preferred embodiment of the invention, the core assembly includes a battery assembly including a battery and a thin enclosure having substantially the shape and dimensions of the battery which is encapsulated therein. A connector having the shape of thin ribbon film provides electrical and flexible mechanical connectivity between the receiver assembly, centrally positioned battery assembly, and microphone assembly positioned in the cartilaginous region. The invention is characterized by the absence of a unitary enclosure or main housing which typically encloses the battery and other components in prior art hearing device designs.

In the preferred embodiment, the hearing device is mass-producible and accommodates a variety of canal shapes and sizes without need for custom manufacturing or canal impressions. This desirable objective is accomplished by virtue of the flexibility of the universal core assembly and conformity of the assorted sealing retainer.

The hearing device of the invention is preferably inserted by a physician, or by another professional under the supervision of a physician, for placement entirely within the ear canal and exceptionally close to the eardrum. The space and energy efficient design allows for a comfortable continuous use within the ear canal for extended periods of time, exceeding one month, without the requirement of daily removal as with conventional CICs. In the preferred embodiments, the device is remotely switched on/off by a remote control for optionally conserving the battery energy while the device remains in the ear canal during sleep or non-use.

The invention eliminates the need for manual insertion and removal by the wearer and is therefore particularly suited for hearing impaired persons of poor manual dexterity.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which:

FIG. 3 is a side view of the ear canal occluded by a conventional CIC hearing aid positioned therein, described above;

FIG. 14*a* is a detailed view of a moisture-proof debris guard in the form of an adhesive pad showing the adhesive layer and receiver sound port for an embodiment of the canal device of the invention; and FIG. 14*b* is a perspective view of the moisture-proof adhesive pad of FIG. 14*a* showing the adhesive layer and adhesive-free area;

FIG. 15 is a side view of the ear canal showing an alternate embodiment of the canal device of the invention positioned entirely in the ear canal and substantially in the bony region thereof;

FIGS. 16*a* and 16*b* are perspective views of a preferred embodiment of the sealing retainer of the canal device, taken respectively from the side (FIG. 16*a*) and from the lateral end (FIG. 16*b*), showing a lateral cavity which partially accommodates the battery assembly indicated by the dotted circle.

DETAILED DESCRIPTION OF THE PREFERRED EMBODIMENTS AND METHODS OF THE INVENTION

Figure 1:
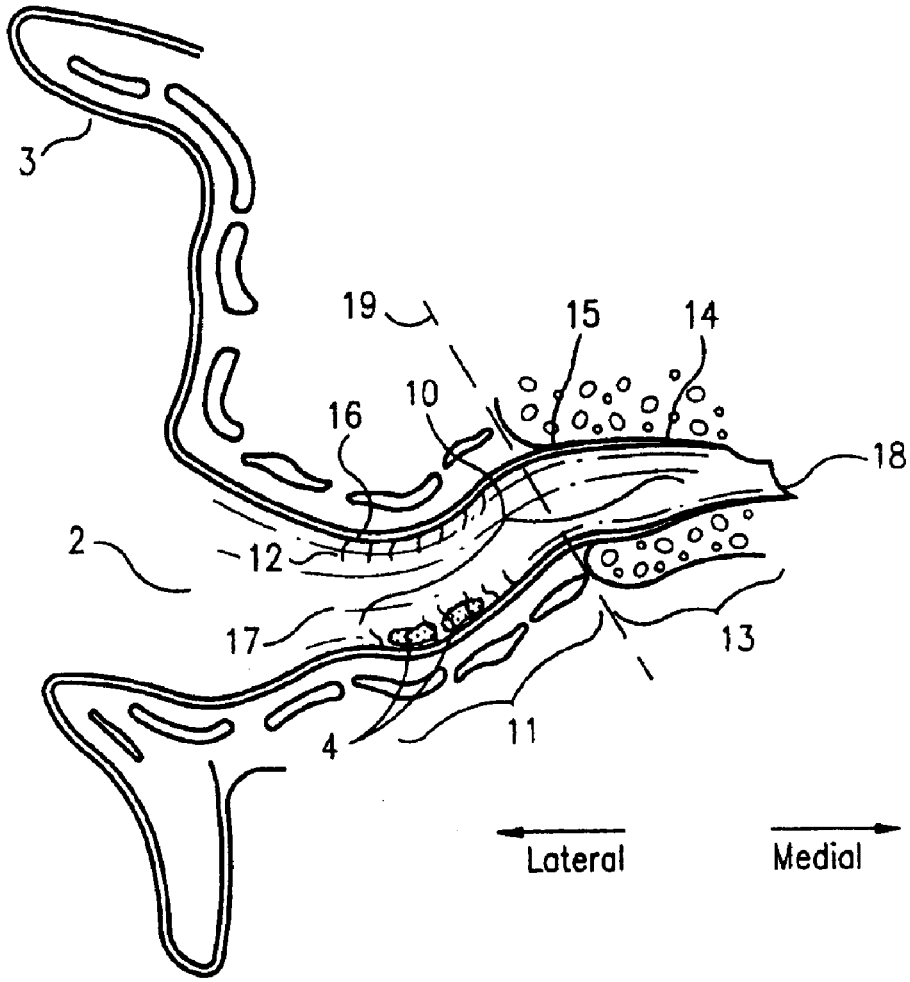
FIG. 1 is a side view of the external ear canal, described above.

The present invention provides a semi-permanent hearing device which is adapted to be entirely positioned in the ear canal for long term use. For the sake of additional clarity and understanding in the ensuing detailed description, the disclosures of the aforementioned related co-pending '533 application and '741 patent (see section titled "Cross-Reference to Related Applications", above) are incorporated herein by reference.

The canal hearing device 30 of the invention will be described with reference to FIGS. 4–16, in which the same reference numbers are used throughout to indicate elements which are common to the several Figures. Hearing device 30 generally comprises a core assembly 35 and a sealing retainer 70 constructed and adapted to be positioned substantially in the bony region 13 of the ear canal. The core assembly 35 includes a receiver (speaker) assembly 60, which is coaxially positioned within the sealing retainer 70.

The core assembly 35 extends to the cartilaginous region 11 in a non-occluding fashion, thus minimizing interference with hair and earwax production present in the cartilaginous part of the ear canal 10. The core assembly 35 also includes a battery assembly 50 having a shape and dimensions substantially equivalent to those of the enclosed battery 51, recognizing that battery assembly 50 has a slightly larger size to accommodate snug enclosure of the battery 51 therein. A connector 53, in the shape of thin circuit film or ribbon cable, provides electrical and mechanical connectivity between the receiver assembly 60, the battery assembly 50, and a microphone assembly 40, the latter being positioned in the cartilaginous region 11 when the hearing device is fully inserted and seated in the ear canal for normal use. The connector 53 is enclosed within the thin enclosure 52 of the battery assembly 50 and extends to the microphone assembly 40 and receiver assembly 60 for connection thereto.

Figure 4:
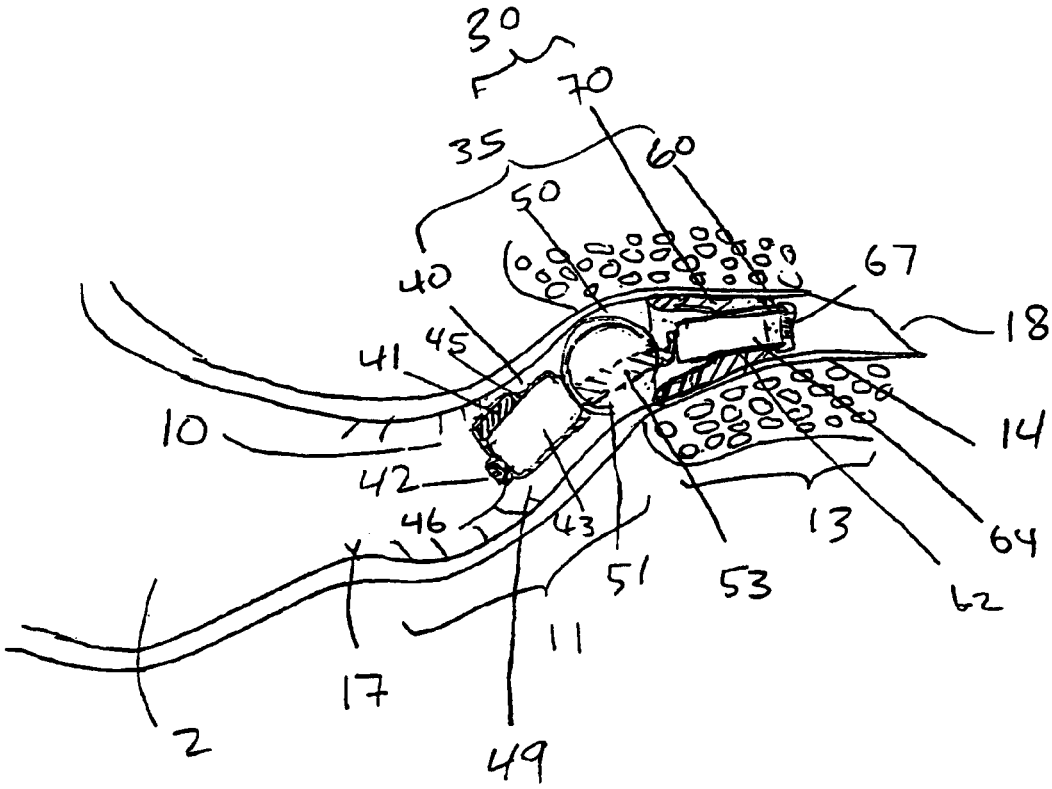
FIG. 4 is a side view of the ear canal showing an embodiment of the semi-permanent canal device of the present invention positioned completely therein, in which the cartilaginous region is unoccluded and the body region is occluded with a sealing retainer.

In a preferred embodiment, shown in FIGS. 4–7, the sealing retainer 70 is adapted to be positioned, as shown, substantially in the bony region 13 concentrically or coaxially over the receiver assembly 60. The sealing retainer 70 is configured to provide the primary support for the device 30 within the ear canal 10. To that end, sealing retainer 70 substantially conforms to the shape of walls 14 of the ear canal in the bony region 13 and retains the device securely within the ear canal 10. The microphone assembly 40, including a microphone 43 therein, is non-occludingly positioned in the cartilaginous region 11 with little or no contact with the walls of the ear canal, thus allowing for a substantial air space 49 therebetween as shown in FIGS. 4, 6*a* and 6*b*. This minimal contact of the microphone assembly 40 allows for natural production and lateral migration of cerumen (earwax) and other debris in the cartilaginous region 11. The receiver assembly 60, in contrast, occludes the ear canal in the bony region 13 via the associated sealing retainer 70, as shown in FIG. 7.

The microphone assembly 40, battery assembly 50, and receiver assembly 60 each having an individual thin encapsulation 45 (FIGS. 6*a*, 6*b*), 52 (FIG. 11) and 62 (FIGS. 7*a*, 7*b*), respectively. The encapsulation preferably comprises a moisture-proof material or coating such as silicone, paralene or acrylic. The thin encapsulation may be made soft, such as soft silicone, or rigid, such as hard acrylic. Any exposed part of connector 53 extending from battery assembly 50 must be moisture-proofed in order to protect the hearing device from the damaging affects of moisture produced within or outside the ear canal.

Figure 17:
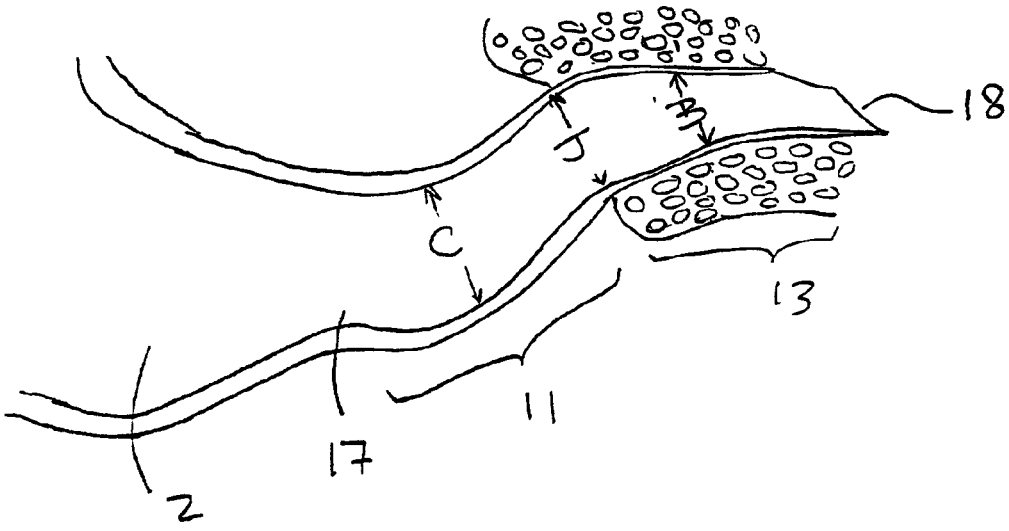
FIG. 17 is a side view of the ear canal showing the central location of the three regions representing the cartilaginous region (C), the bony-cartilaginous junction region (J) and the bony region (B).

The connector 53 and battery 51 are encapsulated by a thin disposable enclosure 52 according to the disclosure of the '741 patent. The battery assembly 50 minimally occludes the ear canal and is preferably positioned substantially at or beyond the bony-cartilaginous junction 19 (FIG. 1; see, also, J of FIG. 17).

Figure 5:
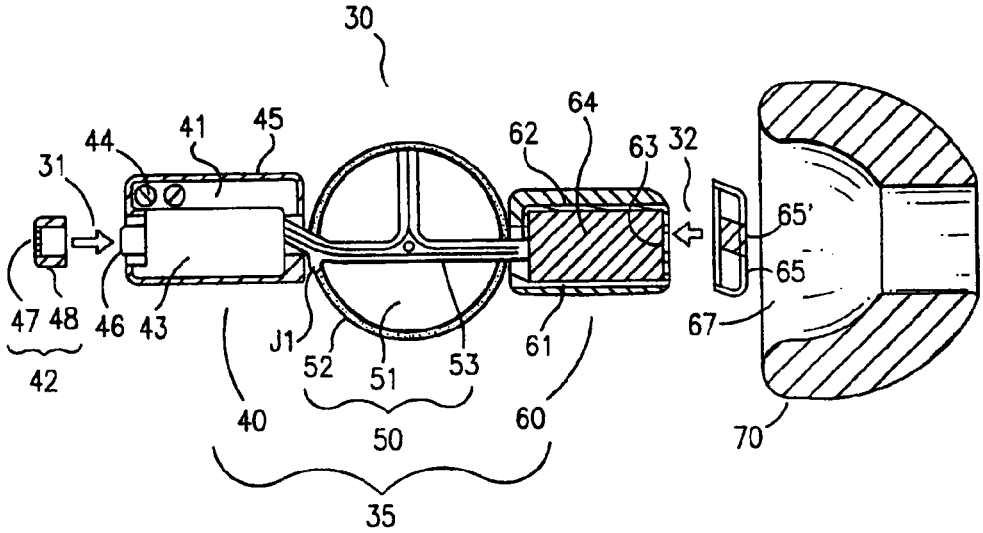
FIG. 5 is a detailed side view of the semi-permanent canal device of FIG. 4, further illustrating replaceable debris guards for the microphone and receiver.

In order to protect the microphone and receiver of the hearing device 30 from the damaging effects of moisture and debris, microphone debris guard 42 (FIG. 5) and receiver debris guard 67 are placed on microphone and receiver ports 46 and 63, respectively. The microphone guard 42 in the embodiments of FIGS. 4 and 5 is in the form of a replaceable cap with a cap body 48 (FIG. 5) fitted over the microphone port 46 (in the direction of arrow 31) and guard member 47 made of a thin membrane or screen material that is substantially transparent to sound. Similarly, receiver guard 67 (FIG. 5) may also be in the form of a replaceable cap with cap body 65 fitted over the receiver in the direction of arrow 32 with guard member 65" positioned over receiver sound port 63. The effect of the microphone and receiver guards 42 and 67, respectively, on the acoustic response of the hearing device is detailed below in the section titled Experiment-C.

When the hearing device 30 is fully inserted in its normal position in the ear canal 10, the microphone assembly 40 is positioned at the cartilaginous region 11 with a substantial air-space 49 all around the microphone assembly (FIGS. 6*a*, 6*b*), between the enclosure 45 of the microphone assembly and the canal skin 16 (walls). The microphone assembly 40 is positioned substantially clear from hair 12 and physiologic debris 4 produced in the cartilaginous region 11.

Figure 6A:
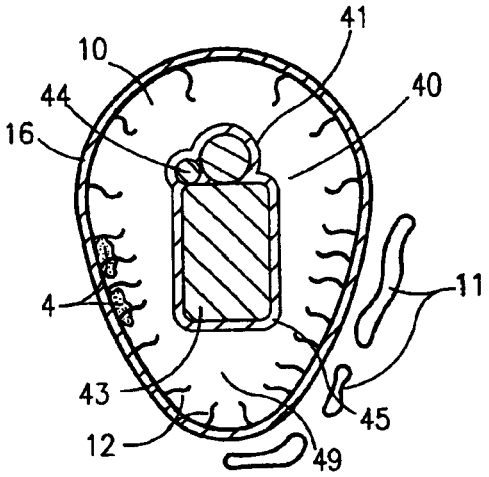
FIGS. 6*a* and 6*b* are cross-sectional views of the ear canal showing the non-occlusive microphone assembly of an embodiment of the canal device of the present invention positioned in the cartilaginous region, providing substantial air-space and no contact with the walls of the ear canal (FIG. 6*a*), and substantial air-space and minimal contact with the walls or physiologic debris of the ear canal (FIG. 6*b*)
Figure 6B:
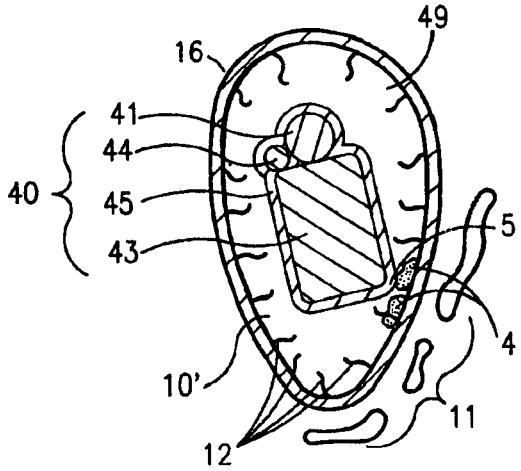

The alternate ear canal 10' of FIG. 6*b* is depicted as being relatively narrow, and although a substantial air-space 49 is also present, the microphone assembly 40 makes minimal contact with the wall of the canal or with physiologic debris 4 therein at the contact area 5. However, connector 53, which is flexibly connected to battery assembly 50 in the preferred embodiment, allows microphone assembly 40 freedom to move along the cross-section of the ear canal in response to pressure from physiologic debris 4 production or canal deformations associated with jaw movements.

Figure 7A:
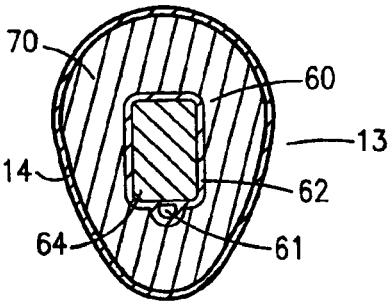
FIGS. 7*a* and 7*b* are cross-sectional views of the ear canal showing the receiver assembly and sealing retainer of an embodiment of the canal device of the invention positioned in the bony region with occlusion thereof (FIG. 7*a*), and with venting incorporated in the sealing retainer (FIG. 7*b*)
Figure 7B:
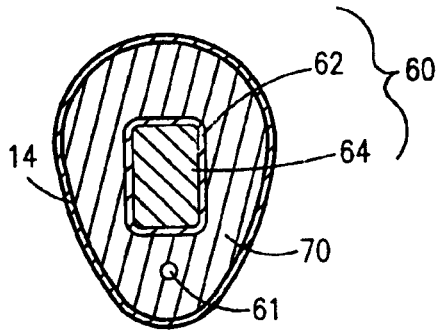

As shown in FIGS. 7*a* and 7*b*, the receiver assembly 60 is positioned in ear canal 10 at bony area 13, with sealing retainer 70 in direct contact with canal skin 14 (walls), thus occluding the bony area of the canal. A vent 61 (FIGS. 5 and 7*a*) is provided for pressure equalization during insertion and removal or during changes in atmosphere pressure. The vent may alternatively be provided across the sealing retainer 70 (FIG. 7*b*). The vent 61 is also provided to minimize occlusion effects described above.

The microphone assembly 40 in the preferred embodiment of FIGS. 4–6, comprises a microphone 43, a control element 41 (i.e., volume trimmer as shown in FIG. 5) and switch assembly 44. The switch assembly 44 comprises a latchable read-switch assembly (RS in FIG. 8), which is remotely activated by a remote magnet (e.g., 120 in FIG. 13) according to the disclosure in the '533 application. The microphone 43 comprises a microphone transducer with an integrated signal processing amplifier (for example, series FI-33XX manufactured by Knowles Electronics of Itasca, Ill.). This integration reduces the size of the microphone assembly, which further reduces occlusion effects within the ear canal at the cartilaginous region. Alternatively, the signal processing amplifier may be a separate component, as shown at 28 in the embodiment of FIG. 12.

Figure 8:
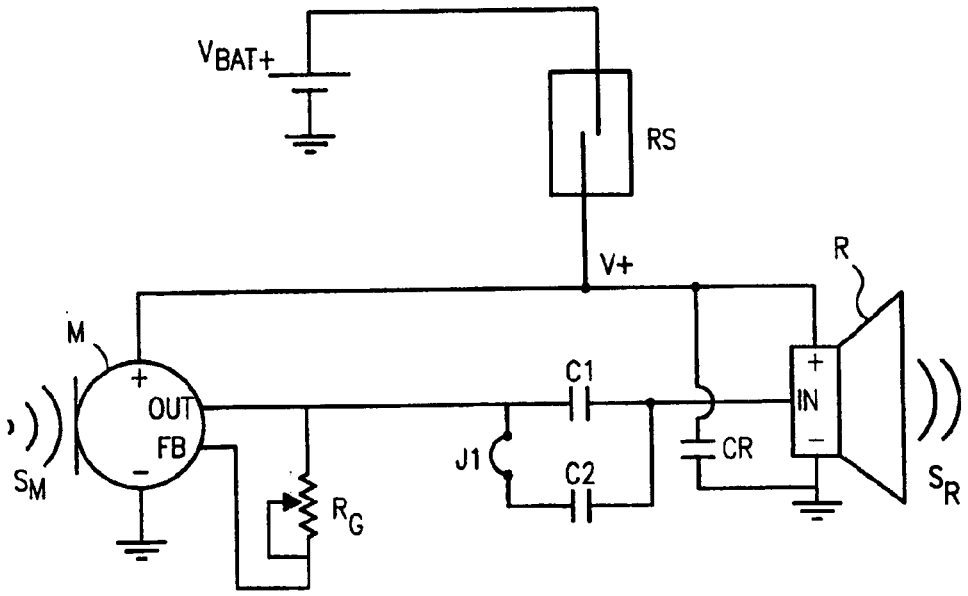
FIG. 8 is an electrical schematic diagram of a prototype embodiment of the canal device of the invention.

A schematic diagram of an electroacoustic circuit of the embodiment of FIGS. 4–7 is shown in FIG. 8. The microphone M, comprising a microphone transducer and signal processing amplifier integrated therein, picks up acoustic signals $S_M$ entering the ear canal and produces amplified electrical signal at terminal OUT of microphone M. The electrical signal is then delivered to input (IN) terminal of the receiver R via coupling capacitors C1 and C2. The receiver R then produces amplified acoustic signal $S_R$ for delivery to the tympanic membrane 18 (FIG. 4). Volume trimmer $R_G$, connecting the output (OUT) and feedback (FB) terminals of the microphone M, is adjusted to set the gain (volume) of the electroacoustic circuit. Jumper J1 (also shown in FIG. 5) may be removed (by cutting for example) to reduce the coupling capacitance, thus altering the frequency response of the hearing device as known to those skilled in the art of electronics. Other jumpers (not shown) may also be incorporated in order to increase the range of adjustable parameters of the hearing device. A capacitor $C_R$ is employed to stabilize the supply voltage (V+) across the supply terminals (+ and –) of the receiver R.

The acoustic response of a device fabricated according to the embodiment of FIGS. 4–7 and the electroacoustic circuit of FIG. 8 was measured and plotted in FIG. 9 with and without moisture-proof guards as detailed below in the section titled Experiment-C.

Figures 10, 11:
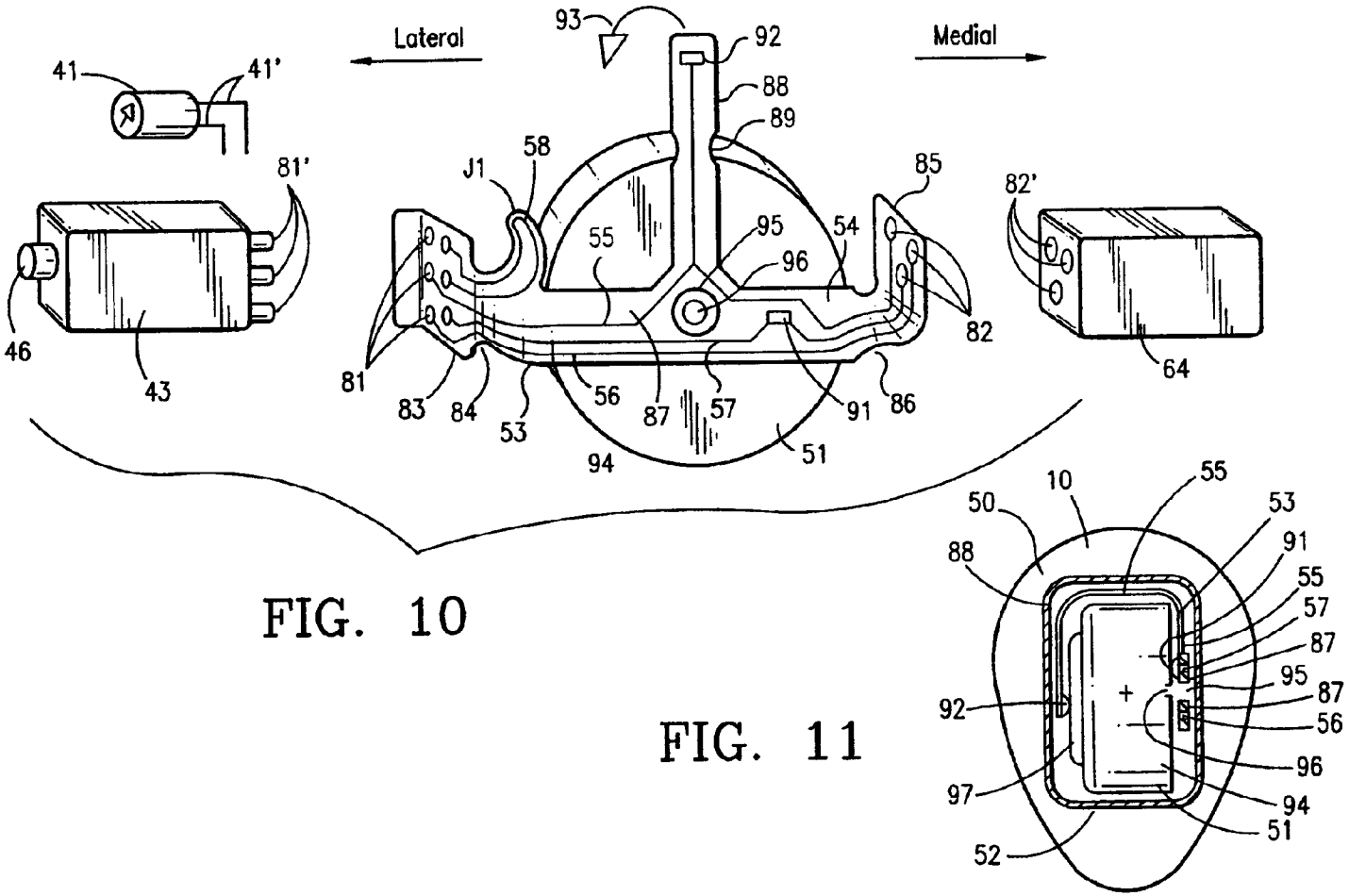
FIG. 10 is a detailed exploded side view of the flexible connector, battery, microphone and receiver parts of an embodiment of the canal device of the present invention, showing the parts unassembled.
FIG. 11 is a cross-sectional view of the ear canal showing the battery assembly of an embodiment of the canal device of the invention positioned therein, with flexible connector, battery and battery enclosure.

The connector 53, in the preferred embodiment shown in more detail in FIG. 10, comprises a flexible film 54 with circuit wires 55, 56, 57 and 58, which electrically interconnect the microphone 43, receiver 64, battery 51, volume trimmer 41, and other components (which are not shown, for the sake of clarity), such as switch assembly 44 (shown in FIG. 5) and capacitors. The microphone 43 (shown unassembled) is soldered to the connector 53 via solder terminals 81 on the lateral section 83 of the flexible film 54 and solder terminals 81' on the microphone 43. Similarly the receiver 64 is soldered to the connector 53 via solder terminals 82 on the medial section 85 of the flexible film 54 and solder terminals 82' on the receiver 64. Conductive pads 91 and 92 on the connector provide power connectivity from the positive 94 and negative 97 (FIG. 11) terminals, respectively, of the battery 51. Volume trimmer 41 is also connected to solder terminals 81 via trimmer solder terminals 41'.

The lateral and medial sections 83 and 85 respectively of film 54 are flexibly bendable with respect to the main section 87, thus allowing the connected microphone assembly 40 and receiver assembly 60 to articulate within the ear canal during insertion and removal of the hearing device. A crossing section 88 of the connector 53 also bends in the direction of arrow 93 (into the paper) in order to connect conductive pad 92 to the negative terminal 97 (FIG. 11) of the battery. The flexible film 54 is provided with relief notches 84, 86 and 89 which increase the flexibility of the sections 83, 85 and 88, respectively. The battery 51, main section 87, and crossing section 88, are encapsulated by thin disposable battery encapsulation 52 (FIG. 11) for securing the connector 53 and the associated conductive pads 91 and 92 to the battery. The main section 87 includes a vent hole 95 for allowing air circulation to battery hole 96, typically available in air-zinc hearing aid batteries. Similarly, the battery encapsulation 52 must allow for the necessary aeration of the battery enclosed therein.

FIG. 11 shows a cross sectional view of the battery assembly 50 in the ear canal 10 showing main section 87 of connector 53, battery 51 and battery encapsulation 52. The crossing section 88, extending from main section 87 is also shown crossing to the negative terminal 97 of the button cell battery 51. Circuit wires 55, 56 and 57 are also shown. The battery encapsulation 52 is thin and substantially conforms to the shape of the battery, thus adding negligible dimensions to the enclosed battery. The battery enclosure should be less than 0.3 mm in thickness in order for the battery assembly to minimally occlude the ear canal and to fit comfortably in the vicinity of the bony-cartilaginous area for most individuals.

Figure 12:
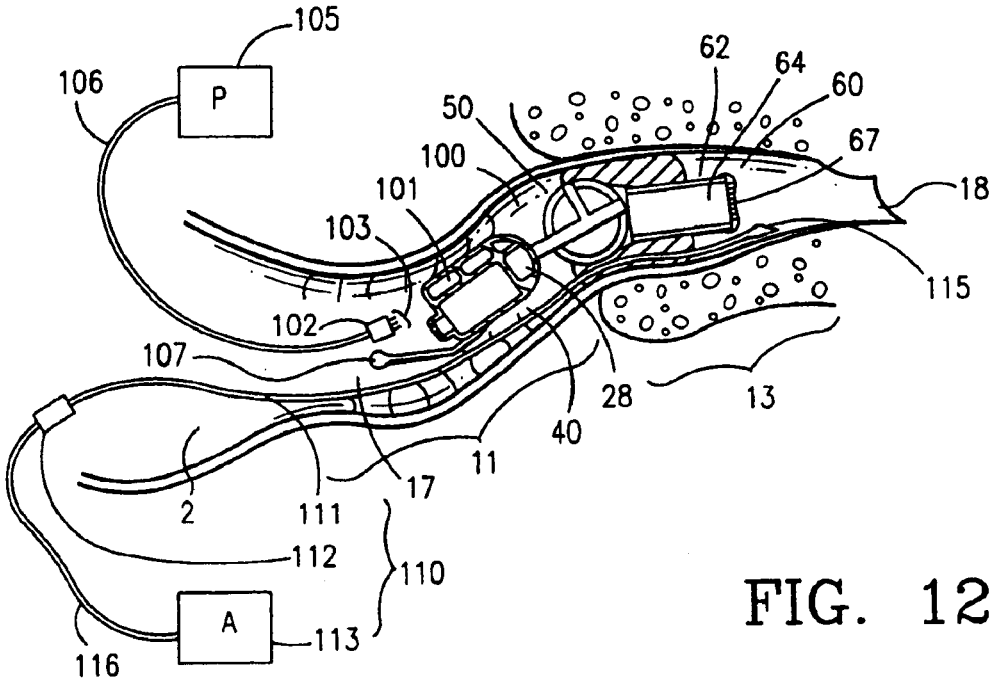
FIG. 12 is a side view of the ear canal showing a programmable embodiment of the canal device of the invention positioned in the ear canal with sealing retainer extending substantially over the battery, and also illustrating a probe tube system with probe tube and external amplifier according to the invention.

In another embodiment, shown in FIG. 12, the hearing device 100 has a microphone assembly 40, which extends substantially laterally in the cartilaginous area 11 as shown. The sealing retainer 70, although remaining substantially in the bony region 13, is concentrically positioned over both the receiver assembly 60 and the battery assembly 50. The receiver assembly 60 protrudes from the sealing retainer medially towards the tympanic membrane 18. The hearing device 100 is also shown as being programmable with a programming receptacle 101 for receiving programming signals from a programming connector 102. The programming connector comprises programming pins 103 which are temporarily inserted into the programming receptacle 101 during the programming of the hearing device 100. The capability to be programmable allows hearing device 100 to be electronically adjusted via an external programming device 105 (P) and its associated programming cable 106. Other means for remotely programming or adjusting a hearing device are well known in the field of hearing aids and include the use of sound, ultrasound, radio-frequency (RF), infra-red (IR) and electromagnetic (EM) signals.

FIG. 12 also shows a probe tube system 110 for the measurement of sound pressure level (SPL) produced by the hearing device 100 in the ear canal. The probe tube system comprises a probe tube 111, a microphone 112 and amplifier (A) 113. Electrical cable 116 connects the microphone 112 to the amplifier 113. The probe tube 111 is inserted in the ear canal with its tip 115 past the receiver assembly 60 near the tympanic membrane 18. Probe tube measurements in the ear canal are employed during the fitting process for the in-situ (while in the ear canal) electroacoustic adjustment and verification of the fitted hearing device.

Removal handle 107 may be provided for the removal of the hearing device 100, particularly during an emergency situation, such as infection of the ear canal or irritation therein.

Figure 13:
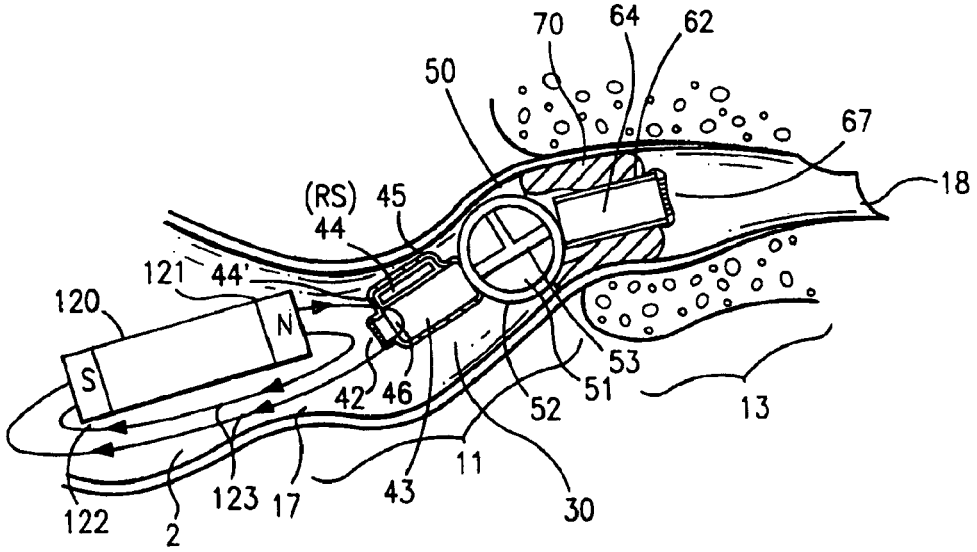
FIG. 13 is a side view of the ear canal showing an embodiment of the canal device of the invention positioned in the ear canal with a latchable magnetic switch and an external control magnet.

In a preferred embodiment of a remote control, shown in FIG. 13, the hearing device 30 comprises a latchable reed-switch assembly 44 (RS) for remotely powering the hearing device ON/OFF via an external control magnet 120 which is positioned by the wearer (user) at the vicinity of the concha 2. The control magnet 120 in the preferred embodiment has two opposing polarities; a north (N) pole 121 and south (S) pole 122, across the length of the control magnet 120 as shown. The flux lines 123 emanating from the north pole towards the south pole affect the lateral (nearer) lead 44' of latchable reed-switch assembly 44. Flux lines 123 either latch on or off the reed-switch assembly 44 according to the polarity of the control magnet 120 nearest to lead 44'. The read-switch assembly 44 comprises a latching magnet (not shown) as disclosed in greater detail in the aforementioned '533 application, and allows hearing device 30 to be turned off to conserve battery power during sleep and other non-use periods while the device remains in the ear canal for long-term use.

The encapsulations 45 and 62 of the microphone receiver assemblies 40 and 60, respectively, are each made of thin protective material that substantially conforms to the shape of the components encapsulated therein. The thickness of each encapsulation is preferably less than 0.3 mm in order to minimize occlusion of the microphone assembly 40 (see FIGS. 6*a* and 6*b*) in the ear canal and to maximize the relative dimension of the conforming sealing retainer 70 in the bony region 13 (see FIGS. 7*a* and 7*b*). Since the semi-permanent hearing device of the invention is handled relatively infrequently, the thickness of the encapsulation can be safely made substantially thinner than conventional enclosures of CIC devices which are typically in the range of 0.5–0.7 mm.

In another embodiment of the moisture-proof debris guard, shown in FIGS. 14*a* and 14*b* for a receiver assembly 60, the debris guard 67 is made in the form of an adhesive pad. The receiver debris guard is composed of an acoustically-transparent material 65 with an adhesive layer 69 on its lateral surface for attachment to the medial surface 63' of receiver assembly 60. The receiver assembly's medial surface 63' includes the receiver sound port 63 which emits receiver sound $S_R$ that passes through the debris guard 67 as illustrated by the arrow. The adhesive layer 69 is partially relieved from adhesive material in the adhesive-free area 65' corresponding to or mating with receiver sound port 63. The adhesive-free area 65' is necessary since adhesives are generally not acoustically transparent, and thus will adversely alter the frequency response of the receiver 64 if applied directly over the sound port 63. The adhesive pad configuration of the debris guard is equally applicable for both the microphone and receiver sound ports, as shown at 42 and 67, respectively, in FIGS. 12–15. The adhesive pad is preferably replaceable and disposable.

The present invention, shown with button cell batteries in the above embodiments, is equally suited to accommodate other battery shapes and configurations as they are likely to be available in future hearing aid applications. The thin enclosure of the battery assembly of the present invention, regardless of the type of battery used, conforms substantially to the shape of the enclosed battery with encapsulation thickness not to exceed 0.3 mm for the preferred embodiments of the invention.

For example, in another embodiment of the present invention, shown in FIG. 15, a cylindrical battery 51 is employed with a hearing device 130 substantially positioned in the bony region 13 of the ear canal 10. The microphone end 132 of the core assembly 35 extends laterally and non-occlusively in the cartilaginous region 11. The receiver end 133 is coaxially positioned within sealing retainer 70, which acoustically seals and conforms in the bony region 13. A thin encapsulation 131, not exceeding 0.3 mm, protects the entire core assembly 35, which comprises the microphone 43, battery 51 and receiver 64 therein.

The sealing retainer 70, shown in greater detail in FIG. 16, comprises a soft compressible and conforming material such as polyurethane foam or like material (a polymer) or silicone or like material. The sealing retainer 70 must provide significant acoustic attenuation in order to seal and prevent feedback. In a preferred embodiment of the sealing retainer fabricated and tested within ear canals of individuals, a polyurethane foam sealing retainer was molded from a mixture of 1-part aqueous solution (Polymer component Type 1A, manufactured by Hamshire Chemicals, Lexington, Mass.) and 2-part prepolymer (HYPOL™ 2002 also manufactured by Hamshire Chemicals). The mixture was poured into a silicone mold (REDU-IT™ manufactured by American Dental Supply Co. of Easten, Pa.) and allowed to heat cure at approximately 195° F. for about 15 minutes prior to removing from the silicone mold at room temperature.

The molded sealing retainer 70 did not include any rigid core material therein in order to maximize the fit and comfort within the bony region of the ear canal. The sealing retainer 70 was made oval with long diameter $D_L$ approximately 1.6 times that of the short diameter $D_S$. The inferior (lower) portion 74 is relatively pointed to match the shape of typical ear canals in the bony region. The sealing retainer 70 is substantially hollow with air-space 72 between the body 73 of the sealing retainer and the receiver assembly 60 when inserted therein. The medial opening 71 of the sealing retainer is stretchable and is made smaller than the diameter of the receiver assembly 60 in order to provide a tight fit for sealing and securing the receiver assembly and the associated hearing device within the ear canal. Vertical and horizontal cavities 75 and 76, respectively, in the shape of a cross, extend medially from the lateral end of the sealing retainer 70. These cavities, in conjunction with the internal air-space 72, increase the compressibility and conformity of the sealing retainer so that it can be worn more comfortably in the bony region 13 which is known for being extremely sensitive to pressure. Furthermore, the cavities 75 and 76 allow for partial enclosure of the battery assembly (dotted circle) 50 therein as shown in FIG. 16*a*.

The sealing retainer 70, made of polyurethane foam material for example as described above, is compressible and subsequently expandable with time, thus allowing for a temporary compression state prior to and during insertion into the ear canal and a subsequent expansion to conform to the ear canal and seal therein.

In a preferred embodiment according to the invention, the sealing retainer 70 was fabricated in an assortment of four sizes (small, medium, large and extra-large) to accommodate the broadest range of ear canals among the population studied. The dimensions of such fabricated assortment are tabulated in Table 1 below. The dimensions were partially derived from measurements of actual ear canal dimensions obtained from cadaver impressions as explained below in the section titled Experiment-A. The sealing retainer may be produced in an assortment of other sizes and shapes as needed to accommodate an even wider diversity of ear canals when studied.

TABLE 1

| Size | Short Diameter ($D_L$) in mm | Large Diameter ($D_L$) in mm |
|---|---|---|
| Small | 4.5 | 7.25 |
| Medium | 5.75 | 9.35 |
| Large | 7.3 | 12 |
| Ex-Large | 9.0 | 15 |

The sealing retainer is preferably disposable and must be biocompatible and hypoallergenic for a safe prolonged wear in the ear canal. The sealing retainer may incorporate a vent 6 as shown in FIG. 7*b*. This vent may created by inserting or molding a narrow-diameter silicone tube therein, for example.

Certain individuals may have difficulty wearing the sealing retainer due to the sensitivity of their ear canal, medical condition, or other concerns. Therefore, the sealing retainer may be separately inserted, without the core assembly, for a period of time sufficient to assess comfort and appropriateness of wear prior to inserting the entire hearing device semi-permanently. This may represent a "trial wear" for an individual who may be reluctant to wear or purchase the device for whatever reason.

The semi-permanent hearing device of the present invention comprises a disposable battery, disposable battery enclosure, or alternatively a disposable battery assembly with combined battery and enclosure. However, as energy efficiency improvements in battery, circuit and transducer technologies continue to improve, the preferred embodiment may be that of a disposable core assembly with assorted sealing retainers as described above.

Experiment A

In a study performed by the applicants herein, the cross-sectional dimensions of ear canals were measured from 10 canal impressions obtained from adult cadaver ears. The long (vertical) and short (horizontal) diameters, $D_L$ and $D_S$ respectively, of cross sections at the center of three regions in the ear canal (see FIGS. 2 and 17) were measured and tabulated. These regions represent the cartilaginous (C), the bony-cartilaginous junction (J), and the bony (B) regions. The diameters where measured across the widest points of each cadaver impression at each region. All measurements were taken by a digital caliper (model CD-6"CS manufactured by Mitutoyo). The impression material used was low viscosity Hydrophilic Vinyl Polysiloxane (manufactured by Densply/Caulk) using a dispensing system (model Quixx manufactured by Caulk). Measurements are set forth in Table 2, below.

TABLE 2

| Sample | C-Region Diameters in mm | | J-Region Diameters in mm | | B-Region Diameters in mm | |
|---|---|---|---|---|---|---|
| # | Short ($D_S$) | Long ($D_L$) | Short ($D_S$) | Long ($D_L$) | Short ($D_S$) | Long ($D_L$) |
| 1-R | 7.8 | 10.3 | 8.1 | 10.7 | 8.0 | 10.5 |
| 1-L | 7.8 | 11.9 | 8.3 | 12.2 | 8.1 | 11.2 |
| 2-R | 3.8 | 8.9 | 4.0 | 8.9 | 4.2 | 8.9 |
| 2-L | 5.3 | 8.1 | 4.4 | 8.8 | 4.3 | 8.6 |
| 3-R | 5.5 | 6.3 | 4.7 | 6.7 | 5.0 | 7.7 |
| 3-L | 4.9 | 6.5 | 4.9 | 6.5 | 4.9 | 7.3 |
| 4-R | 6.9 | 9.2 | 6.5 | 9.6 | 6.7 | 10.4 |
| 5-R | 6.9 | 9.2 | 7.2 | 8.4 | 7.5 | 9.5 |
| 5-L | 6.8 | 8.2 | 7.6 | 9.4 | 7.5 | 8.7 |
| 7-L | 6.3 | 7.0 | 5.1 | 6.7 | 4.9 | 6.7 |
| Average | 6.2 | 8.6 | 6.1 | 8.8 | 6.1 | 9.0 |

Results and Conclusion

The diameter dimensions of the ear canal vary significantly among adult individuals. In general, variations occur more so across the short (horizontal) diameters. Furthermore, the ear canal is slightly narrower (long/short ratio) in the bony region than in the other two regions. Although not apparent from the above measurements, the cartilaginous region is expandable which facilitates insertion of wider objects through it towards the deeper region, if necessary.

Experiment B

A test of insertion fit of the semi-permanent canal device was performed using the battery assembly of the invention. The battery assembly was selected because it represents the largest of all assemblies in the hearing device according to the present invention.

Using the 10 cadaver impressions described above in Experiment-A, 10 actual-size ear canal models were fabricated by dip-forming clear acrylic material (Audacryl-acrylic manufactured by Esschem). Two battery assemblies according to the embodiment of FIGS. 10–11 were fabricated and inserted in each of the 10 ear canal models up to the bony-cartilaginous junction area. The first assembly comprised a size-10A battery and the second comprised size-312 battery (each is a standard button cell hearing aid battery; see FIG. 2). Each battery assembly included a thin flexible connector and was encapsulated with silicone conformal coating (model MED 10-6605 manufactured by NuSil). The thickness of the coating measured approximately 0.05 mm, thus adding negligible dimensions to the battery assembly and flexible connector thereof. The diameter (D) and height (H) of each assembly was measured across the widest points as tabulated in Table 3, below.

Figure 2A:
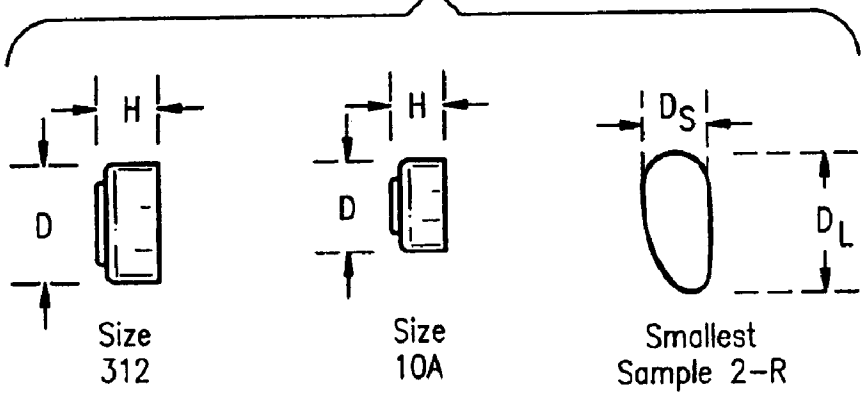
FIG. 2 is a cross-sectional view of the ear canal at the bony-cartilaginous junction for (a) small canal, (b) average size canal and (c) large canal, showing the relative dimensions of standard button cell hearing aid batteries, sizes 10A and 312.
Figure 2B:
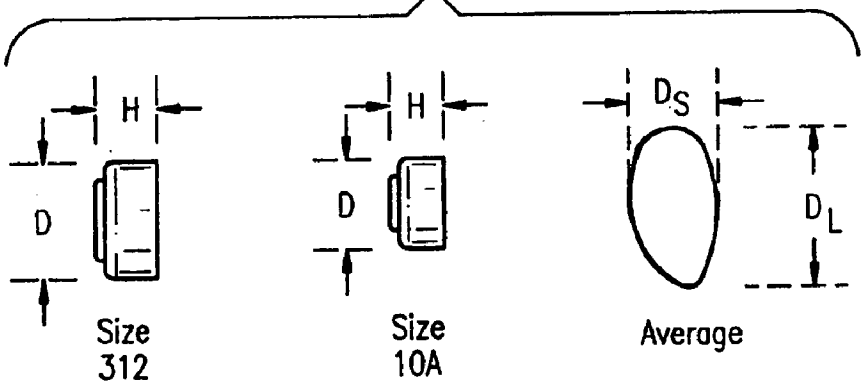

FIG. 2 is a cross-sectional view of the ear canal at the bony-cartilaginous junction for (a) the smallest canal, (b) an average size canal and (c) the largest canal. The relative dimensions of standard 10A and 312 batteries are also shown.

The thickness of several shells of conventional hearing devices were also measured by comparison analysis (measuring between 0.5 mm and 0.7 mm). For a conventional hearing device enclosing size-10A battery, the added dimensions of (1) the shell (0.5 mm or more, adding a minimum of 1 mm to the dimensions) and (2) other enclosed components, prohibit insertion of the device at the bony-cartilaginous junction (J) area for at least 5 of the above ear canals (2-R, 2-L, 3-R, 3-L and 7-L). This is further exacerbated by the fact that ear canals are often tortuously contoured, thus making it painful if not impossible to insert the conventional CIC device too deeply in seeking to gain access to the bony region of the ear canal. For conventional CIC devices with size-312 battery (larger than 10-A), deep fitting is only likely for very large ear canals, such as 1-R and 1-L.

TABLE 3

| Battery Assembly | Height (H) in mm | Diameter (D) in mm |
|---|---|---|
| 10A Bat. | 4.4 (H) | 6.5 (D) |
| 312 Bat. | 4.5 (H) | 8.0 (D) |

Results and Conclusion

The first battery assembly (size-10A) was successfully inserted up to the bony-cartilaginous junction (J) region in 9 of the 10 ear canal models, excepting 2-R which has dimensions of 4.0×8.9 mm ($D_S \times D_L$) as shown in FIG. 2.

The second battery assembly (size-312) was successfully inserted up to the bony-cartilaginous junction in 5 of the 10 ear canal models. This is particularly significant, since size-312 batteries are virtually excluded from conventional CIC devices due to their excessive size in conjunction with conventional CIC designs.

The results confirm that the present invention is more space-efficient and would allow the battery assembly to fit in the bony-cartilaginous junction area and beyond for most adult individuals with size-10A batteries and a significant percentage of adult individuals with size-312 batteries.

Experiment C

A prototype of the semi-permanent hearing device according to the embodiment of FIGS. 4–10 was fabricated and positioned by an otolaryngologist (ear-nose-throat physician) in the left ear canal of a 55 year old male subject who suffered a moderate level of high frequency hearing loss.

The circuit of FIG. 8 was implemented with a miniature microphone/amplifier (model FI-3342 manufactured by Knowles Electronics of Itasca, Ill.), class-D receiver (model FS3379 also manufactured by Knowles Electronics), and miniature 250K ohm volume trimmer $R_G$ (model PJ-62 manufactured by Microtronics A/S of Denmark). Miniature capacitors C1, C2 and $C_R$ with values of 2.2 nF, 0.01 uF and 2.2 uF, respectively were employed. A reed switch assembly (RS) employing a miniature reed-switch (model HSR-003DT, manufactured by Hermetic Switch, Inc. of Chickasha, Okla.) and a miniature Neudymium Iron Boron (NdFeB) magnet for latching the reed-switch.

Two layers of thin Kapton tape (#042198 GUA distributed by Economic Packaging Corp. of Milpitas, Calif.) were employed to fabricate a thin flexible connector which embedded circuit wires made of 44 AWG Litz wire.

The microphone assembly, comprising microphone amplifier M, reed-switch assembly RS, volume trimmer $R_G$, and lateral section 83 of flexible connector 53 were glued together using cyanoacrylate (#20269, manufactured by Loctite Corp. of Rocky Hill, Ct.). The microphone assembly was then encapsulated by thin moisture proofing silicone material (E41 manufactured by Wacker, Werk Burghausen of Germany). The receiver assembly, comprising receiver and $C_R$ capacitor was similarly encapsulated by silicone material and was flexibly connected to the Kapton tape connector.

The moisture-proof debris guard for the microphone and receiver ports employed Gore-Tex™ material (#VE00105 manufactured by W.L. Gore & Associates of Elkton, Md.) for guard member and polypropylene plastic (#100-8932 distributed by Henry Schein/ZAHN of Esschem of Port Washington, N.Y.) for the body of the guard cap. The guard member material was approximately 0.2 mm in thickness.

A large-sized sealing retainer was fabricated using the above mentioned polymer foam material and fabrication process.

The device, excluding the retainer seal, weighed 0.73 grams, including the 10A battery which weighed 0.29 grams alone.

The subject was provided with a control magnet, in the shape of a bar, for remotely switching the device on or off as desired.

Figure 9:
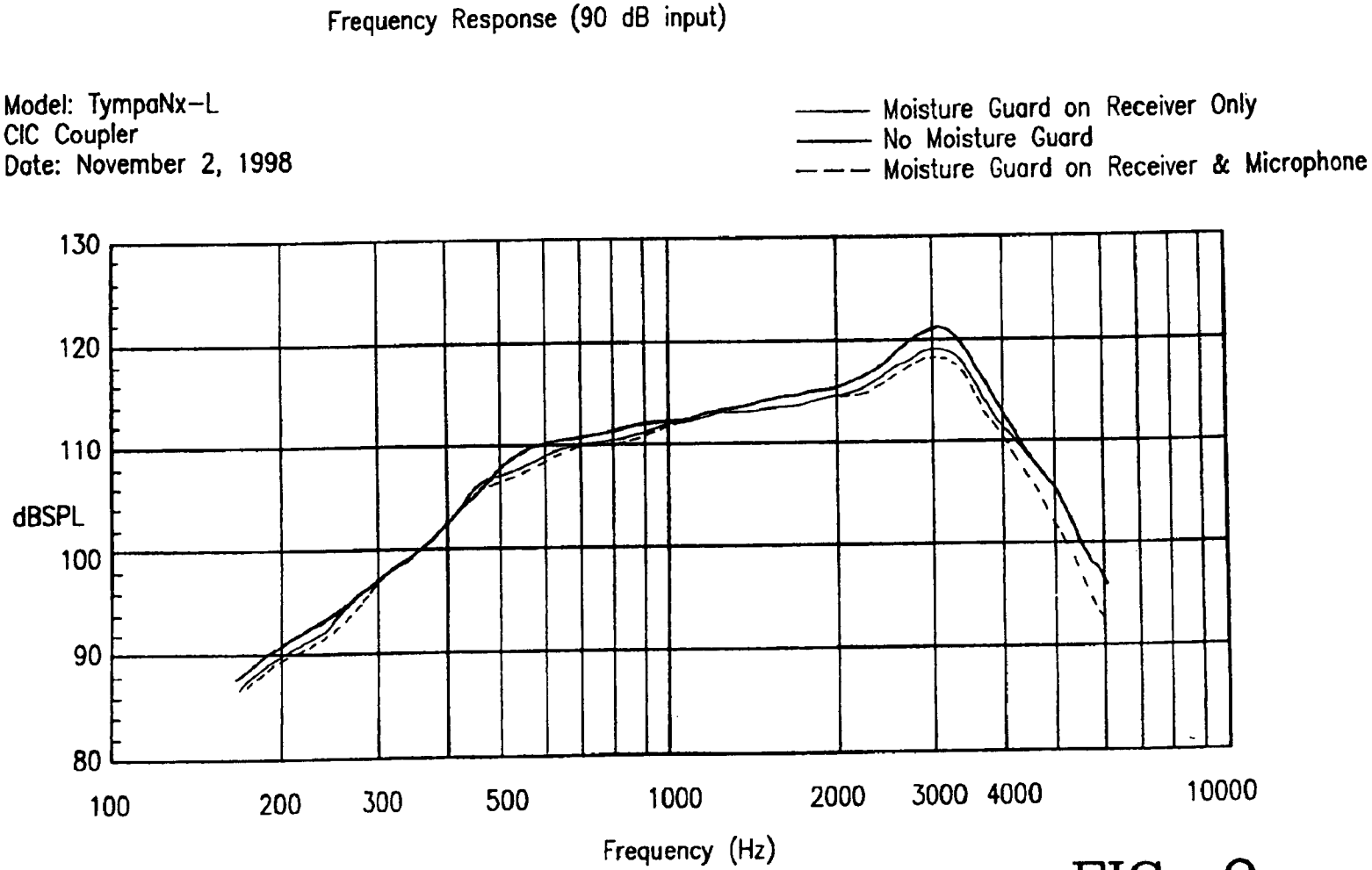
FIG. 9 is a graph of the acoustic response of the prototype embodiment of FIG. 8 showing the acoustic effect with and without the moisture-proof debris guards placed on the microphone and the receiver of the prototype embodiment.

The acoustic response of the prototype device was measured in a standard CIC coupler (Manufactured by Frye Electronics) and plotted in FIG. 9. The response was measured without debris guard (thick solid line labeled No Moisture Guard), with receiver guard (solid line labeled Moisture Guard on Receiver Only), and with debris guards on both receiver and microphone (dotted line labeled Moisture Guard on Receiver and Microphone).

Results and Conclusion

There was a slight sound degradation (approximately 4 decibels (dB)) at frequencies of 3000 and above compared to the No Moisture Guard condition. However, this represents a minimal acoustic impact which can be easily compensated for electronically or by the employment of thinner guard material.

The prototype device, including receiver and microphone debris guards according to the embodiment of FIG. 5, and the sealing retainer, was worn deeply and completely inconspicuously in the ear canal of the 55 year old subject. The tip of the receiver was approximately 2–3 mm from the tympanic membrane. The volume trimmer was adjusted in-situ by a miniature screwdriver until the preferred volume level was reached for the subject who reported good sound fidelity and comfort of wear. The device was worn comfortably during sleep. The subject was also able to shower while the device was in the ear canal without adverse affects on the perceived quality of sound.

It should also be noted that the moisture-proofing provided by the debris guards and enclosures according to the invention can even afford the wearer the opportunity to engage in normal swimming without fear of damage to or loss of fidelity of the hearing device. It would not be recommended that the wearer engage in diving or prolonged underwater swimming, however.

It is also worth emphasis that the sealing retainer itself provides significant advantages for use with a semi-permanent hearing device adapted to be inserted entirely within the ear canal of a wearer past the aperture. The sealing retainer is configured for concentric positioning over a medial part of a core assembly of the hearing device so that the core assembly extends laterally within and makes minimal or no contact with the walls of the cartilaginous region of the ear canal. The core assembly is suspended within and snugly supported at the medial part by the sealing retainer, and is arranged and adapted to protrude medially beyond the sealing retainer in a preferred embodiment. The sealing retainer is further configured for seating securely within and occluding the bony region of the ear canal when the semi-permanent hearing device is fully inserted within the ear canal of the wearer. The sealing retainer is sufficiently soft and yielding to conform itself to the shape of the ear canal in the bony region.

Consequently, the sealing retainer provides acoustic sealing of the bony region to prevent feedback, and the lateral extension of the core assembly avoids substantial interference with hair and production of cerumen and debris in the cartilaginous region.

According to another aspect of the invention, in a method of testing a hearing-impaired individual's tolerance to long-term wearing of a semi-permanent hearing device inserted entirely within the ear canal past the aperture thereof, the testing is performed without requiring the individual to actually wear the entire hearing device. The method includes a first step of inserting the sealing retainer into the ear canal, with the air cavity of the retainer unoccupied by the core assembly, until the retainer is seated securely against the walls in the bony region. The sealing retainer is removed from the ear canal after having been worn by the individual for a period of sufficient length to determine the long-term tolerance. The individual is interviewed to assess his or her view of the level of comfort and sensitivity to the presence of the device in the ear canal. The ear canal is also examined after removal of the sealing retainer.

It is highly desirable to maintain an inventory of assorted sizes and shapes of the sealing retainer for selection of an appropriate fit for the ear canal of the individual.

Although a presently contemplated best mode of practicing the invention has been described herein, it will be recognized by those skilled in the art to which the invention pertains from a consideration of the foregoing description of presently preferred and alternate embodiments and methods of fabrication and use thereof, that variations and modifications of this exemplary embodiments and methods may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A semi-permanent hearing device configured to be inserted entirely within a wearer's ear canal past the canal aperture for long-term use therein, the device comprising:

a sealing retainer configured to be seated in a bony portion of the ear canal along the longitudinal axis and in direct contact with walls of the ear canal when the device is fully inserted within the canal, the sealing retainer being conformable to the shape of the canal;

a receiver assembly configured to mate with the sealing retainer for positioning in a bony portion of the canal, the receiver assembly including a receiver for supplying acoustic signals processed by the device to a tympanic membrane of the wearer;

a microphone assembly separate from the microphone assembly and including a microphone configured to receive incoming acoustic signals for processing by the device, thereby overcoming the need for a unitary enclosure which typically encloses the battery and microphone components, the microphone assembly sized to be substantially non-occluding of a single cartilaginous portion of the canal;

a flexible connector for providing a direct electrical and mechanical connection to flexibly coupling the receiver assembly and the microphone assembly, the connector configured to flexibly support the microphone assembly in the cartilaginous portion of the canal so as to have minimal contact with the canal walls and allow freedom of movement of the microphone assembly across a cross section of the ear canal in response to an applied force; and a battery assembly coupled to at least one of the flexible connector, the receiver assembly and the microphone assembly, the battery assembly including a battery for powering the device.

2. The semi-permanent hearing device of claim 1, wherein the battery assembly includes a thin enclosure substantially conforming to the shape of the battery, the enclosure encapsulating and supporting the battery therein.

3. The semi-permanent hearing device of claim 2, wherein each of the receiver assembly and the microphone assembly includes a respective thin enclosure encapsulating the receiver and the microphone respectively, whereby, together with the thin enclosure of the battery assembly, to inhibit contamination and damage of the device.

4. The semi-permanent hearing device of claim 3, wherein each of the thin enclosures is moisture-proof.

5. The semi-permanent hearing device of claim 3, wherein each of the thin enclosures has a wall thickness not exceeding 0.3 mm.

6. The semi-permanent hearing device of claim 2, wherein the battery is removable from the thin enclosure.

7. The semi-permanent hearing device of claim 2, wherein the battery assembly is removable from the device.

8. The semi-permanent hearing device of claim 1, wherein the sealing retainer is sufficiently soft and yielding to conform itself to the shape of the ear canal in the bony portion for long-term retention in a seated position therein when the device is fully inserted into the ear canal.

9. The semi-permanent hearing device of claim 1, wherein the sealing retainer includes a cavity to accept the receiver assembly in mating relationship therewith.

10. The semi-permanent hearing device of claim 9, wherein the cavity is positioned in the sealing retainer coaxially with an axis to substantially coincide with the longitudinal axis of the ear canal in the bony portion thereof when the device is fully inserted into the ear canal, whereby to support the receiver assembly along the longitudinal axis in the vicinity of the tympanic membrane of the wearer.

11. The semi-permanent hearing device of claim 9, wherein the cavity is medially shaped to conform at least partially to the battery assembly for acceptance thereof.

12. The semi-permanent hearing device of claim 1, wherein each of the receiver and the microphone has a port for passage of the respective acoustic signal therethrough, and further including at least one debris guard for mating with at least one of the microphone and the receiver without substantial interference with passage of the acoustic signal through the respective port.

13. The semi-permanent hearing device of claim 12, wherein the at least one debris guard is moisture proof.

14. The semi-permanent hearing device of claim 12, wherein the at least one debris guard is substantially acoustically transparent.

15. The semi-permanent hearing device of claim 12, wherein the at least one debris guard comprises a replaceable cap.

16. The semi-permanent hearing device of claim 15, wherein the replaceable cap comprises a body member and guard member.

17. The semi-permanent hearing device of claim 12, wherein the at least one debris guard comprises an adhesive pad incorporating an adhesive.

18. The semi-permanent hearing device of claim 12, wherein the at least one debris guard is removable and disposable for replacement thereof.

19. The semi-permanent hearing device of claim 1, wherein the support of the microphone assembly via the connector is sufficiently flexible to enable movement of the microphone assembly in response to forces from sources including physiologic debris collected in the ear canal and canal deformations associated with movements of the ear canal.

20. The semi-permanent hearing device of claim 1, wherein the receiver assembly includes an air vent.

21. The semi-permanent hearing device of claim 1, wherein the sealing retainer includes an air vent.

22. The semi-permanent hearing device of claim 1, further including a reed-switch assembly coupled to the device for magnetically-induced remote power switching or control of the device.

23. The semi-permanent hearing device of claim 22, wherein the reed-switch assembly includes a miniature latching magnet to enable latching of the reed-switch assembly.

24. The semi-permanent hearing device of claim 1, further including means associated with the device for remote power switching or control of the device.

25. The semi-permanent hearing device of claim 24, wherein the means for remote power switching or control of the device comprises an external control magnet sized to be hand-held.

26. The semi-permanent hearing device of claim 25, wherein the external control magnet is bar-shaped.

27. The semi-permanent hearing device of claim 1, wherein the microphone assembly includes amplifier means integral therewith for processing the incoming signal.

28. The semi-permanent hearing device of claim 1, wherein the flexible connector comprises a thin film circuit.

29. The semi-permanent hearing device of claim 28, wherein the thin film circuit comprises a main section associated with the battery assembly, a medial section associated with the receiver assembly, and a lateral section associated with the microphone assembly.

30. The semi-permanent hearing device of claim 29, wherein the medial and lateral sections are bendable with respect to the main section.

31. The semi-permanent hearing device of claim 1, wherein the flexible connector includes electrically conductive pads for connection to terminals of the battery.

32. The semi-permanent hearing device of claim 1, wherein the flexible connector includes a crossing section for connection to a crossing terminal of the battery.

33. The semi-permanent hearing device of claim 1, further including manually adjustable control means for adjusting at least one electro acoustic parameter of the device.

34. The semi-permanent hearing device of claim 33, wherein the manually adjustable control means includes at least one electrical jumper for enabling the adjustment.

35. The semi-permanent hearing device of claim 1, including programming means for selectively adjusting electro acoustic parameters of the device.

36. The semi-permanent hearing device of claim 35, wherein the programming means includes a programmer external to the device and adjustment means internal to the device responsive to programming signals from the programmer for performing the selective adjustment.

37. The semi-permanent hearing device of claim 36, wherein the programmer includes an electrical cable for connection to the device for delivering the programming signals to the internal adjustment means.

38. The semi-permanent hearing device of claim 36, wherein the programmer and the internal adjustment means include means for remote programming of the device by delivery of the programming signals without a physical connection there between.

39. The semi-permanent hearing device of claim 38, wherein the remote programming means includes means for transmitting and receiving at least one of sound, ultrasound, magnetic, electromagnetic, radio frequency and infrared signals as the programming signals.

40. The semi-permanent hearing device of claim 1, including measuring means for performing in-situ probe tube measurements of parameters of the device.

41. The semi-permanent hearing device of claim 1, wherein at least a portion of the sealing retainer comprises polyurethane, polyurethane foam or silicone.

42. The semi-permanent hearing device of claim 1, wherein the sealing retainer is removable or removable and disposable for replacement thereof.

43. The semi-permanent hearing device of claim 1, wherein the sealing retainer is configured to provide sufficient acoustic sealing within the bony portion of the ear canal to substantially prevent the acoustic signals emanating from the receiver from feeding back to the microphone.

44. The semi-permanent hearing device of claim 1, wherein the sealing retainer is selectable from among an assortment of sealing retainers of different sizes and shapes supplied with the hearing device to accommodate the dimensions of the ear canal of the individual wearer.

45. The semi-permanent hearing device of claim 1, wherein the battery is a button cell type battery.

46. The semi-permanent hearing device of claim 1, wherein the receiver assembly protrudes medially beyond the sealing retainer.

47. The semi-permanent hearing device of claim 1, wherein the connector has a varying flexibility along a length of the connector.

48. A semi-permanent hearing device configured to be inserted entirely within a wearer's ear canal past the canal aperture for long-term use therein, the device comprising:

a sealing retainer configured to be seated in a bony portion of the ear canal along the longitudinal axis and in direct contact with walls of the ear canal when the device is fully inserted within the canal, the sealing retainer being conformable to the shape of the canal;

a receiver assembly configured to mate with the sealing retainer for positioning in a bony portion of the canal, the receiver assembly including a receiver for supplying acoustic signals processed by the device to a tympanic membrane of the wearer;

a microphone assembly including a microphone configured to receive incoming acoustic signals for processing by the device, the microphone assembly sized to be substantially non-occluding of a cartilaginous portion of the canal;

a flexible connector flexibly coupling the receiver assembly and the microphone assembly, the connector configured to flexibly support the microphone assembly in the cartilaginous portion of the canal so as to have a void space between a substantial portion of a microphone assembly perimeter and the walls of the cartilaginous portion; and a battery assembly coupled to at least one of the flexible connector, the receiver assembly and the microphone assembly, the battery assembly including a battery for powering the device.

49. A semi-permanent hearing device configured to be inserted entirely within a wearer's ear canal past the canal aperture for long-term use therein, the device comprising:

a sealing retainer configured to be seated in a bony portion of the ear canal along the longitudinal axis and in direct contact with walls of the ear canal when the device is fully inserted within the canal, the sealing retainer being conformable to the shape of the canal;

a receiver assembly configured to mate with the sealing retainer for positioning in a bony portion of the canal, the receiver assembly including a receiver for supplying acoustic signals processed by the device to a tympanic membrane of the wearer;

a microphone assembly including a microphone configured to receive incoming acoustic signals for processing by the device, the microphone assembly sized to be substantially non-occluding of a cartilaginous portion of the canal;

a flexible connector flexibly coupling the receiver assembly and the microphone assembly, the connector configured to flexibly support the microphone assembly in the cartilaginous portion of the canal and allow freedom of movement of the microphone assembly across a cross section of the ear canal in response to an applied force, the connector having a varying flexibility across a portion of the connector; and a battery assembly coupled to at least one of the flexible connector, the receiver assembly and the microphone assembly, the battery assembly including a battery for powering the device.

* * * * *

UNITED STATES PATENT AND TRADEMARK OFFICE

CERTIFICATE OF CORRECTION

PATENT NO. : 6,940,988 B1
DATED : September 6, 2005
INVENTOR(S) : Shennib et al.

It is certified that error appears in the above-identified patent and that said Letters Patent is hereby corrected as shown below:

Column 18,
Line 55, delete entire claims and replace with the following:

1. A semi-permanent hearing device configured to be inserted entirely within a wearer's ear canal past the canal aperture for long-term use therein, the device comprising:

a sealing retainer configured to be seated in a bony portion of the ear canal along the longitudinal axis and in direct contact with walls of the ear canal when the device is fully inserted within the canal, the sealing retainer being conformable to the shape of the canal;

a receiver assembly configured to mate with the sealing retainer for positioning in a bony portion of the canal, the receiver assembly including a receiver for supplying acoustic signals processed by the device to a tympanic membrane of the wearer;

a microphone assembly including a microphone configured to receive incoming acoustic signals for processing by the device, the microphone assembly sized to be substantially non-occluding of a cartilaginous portion of the canal;

a flexible connector flexibly coupling the receiver assembly and the microphone assembly, the connector configured to flexibly support the microphone assembly in the cartilaginous portion of the canal so as to have minimal contact with the canal walls and allow freedom of movement of the microphone assembly across a cross section of the ear canal in response to an applied force; and a battery assembly coupled to at least one of the flexible connector, the receiver assembly and the microphone assembly, the battery assembly including a battery for powering the device.

2. The semi-permanent hearing device of claim 1, wherein the battery assembly includes a thin enclosure substantially conforming to the shape of the battery, the enclosure encapsulating and supporting the battery therein.

3. The semi-permanent hearing device of claim 1, wherein the sealing retainer is sufficiently soft and yielding to conform itself to the shape of the ear canal in the bony portion for long-term retention in a seated position therein when the device is fully inserted into the ear canal.

It is certified that error appears in the above-identified patent and that said Letters Patent is hereby corrected as shown below:

Column 18 (cont'd),

3. The semi-permanent hearing device of claim 1, wherein the sealing retainer is sufficiently soft and yielding to conform itself to the shape of the ear canal in the bony portion for long-term retention in a seated position therein when the device is fully inserted into the ear canal.

4. The semi-permanent hearing device of claim 1, wherein the sealing retainer includes a cavity to accept the receiver assembly in mating relationship therewith.

5. The semi-permanent hearing device of claim 2, wherein each of the receiver assembly and the microphone assembly includes a respective thin enclosure encapsulating the receiver and the microphone respectively, whereby, together with the thin enclosure of the battery assembly, to inhibit contamination and damage of the device.

6. The semi-permanent hearing device of claim 5, wherein each of the thin enclosures is moisture-proof.

7. The semi-permanent hearing device of claim 5, wherein each of the thin enclosures has a wall thickness not exceeding 0.3 mm.

8. The semi-permanent hearing device of claim 1, wherein each of the receiver and the microphone has a port for passage of the respective acoustic signal therethrough, and further including at least one debris guard for mating with at least one of the microphone and the receiver without substantial interference with passage of the acoustic signal through the respective port.

9. The semi-permanent hearing device of claim 8, wherein the at least one debris guard is moisture proof.

10. The semi-permanent hearing device of claim 8, wherein the at least one debris guard is substantially acoustically transparent.

11. The semi-permanent hearing device of claim 8, wherein the at least one debris guard comprises a replaceable cap.

It is certified that error appears in the above-identified patent and that said Letters Patent is hereby corrected as shown below:

Column 18 (cont'd),

12. The semi-permanent hearing device of claim 11, wherein the replaceable cap comprises a body member and guard member.

13. The semi-permanent hearing device of claim 8, wherein the at least one debris guard comprises an adhesive pad incorporating an adhesive.

14. The semi-permanent hearing device of claim 8, wherein the at least one debris guard is removable and disposable for replacement thereof.

15. The semi-permanent hearing device of claim 1, wherein the support of the microphone assembly via the connector is sufficiently flexible to enable movement of the microphone assembly in response to forces from sources including physiologic debris collected in the ear canal and canal deformations associated with movements of the ear canal.

16. The semi-permanent hearing device of claim 1, wherein the receiver assembly includes an air vent.

17. The semi-permanent hearing device of claim 1, wherein the sealing retainer includes an air vent.

18. The semi-permanent hearing device of claim 1, further including a reed-switch assembly coupled to the device for magnetically-induced remote power switching or control of the device.

19. The semi-permanent hearing device of claim 18, wherein the reed-switch assembly includes a miniature latching magnet to enable latching of the reed-switch assembly.

20. The semi-permanent hearing device of claim 1, further including means associated with the device for remote power switching or control of the device.

It is certified that error appears in the above-identified patent and that said Letters Patent is hereby corrected as shown below:

Column 18 (cont'd),

21. The semi-permanent hearing device of claim 20, wherein the means for remote power switching or control of the device comprises an external control magnet sized to be hand-held.

22. The semi-permanent hearing device of claim 21, wherein the external control magnet is bar-shaped.

23. The semi-permanent hearing device of claim 1, wherein the microphone assembly includes amplifier means integral therewith for processing the incoming signal.

24. The semi-permanent hearing device of claim 1, wherein the flexible connector comprises a thin film circuit.

25. The semi-permanent hearing device of claim 24, wherein the thin film circuit comprises a main section associated with the battery assembly, a medial section associated with the receiver assembly, and a lateral section associated with the microphone assembly.

26. The semi-permanent hearing device of claim 25, wherein the medial and lateral sections are bendable with respect to the main section.

27. The semi-permanent hearing device of claim 1, wherein the flexible connector includes electrically conductive pads for connection to terminals of the battery.

28. The semi-permanent hearing device of claim 1, wherein the flexible connector includes a crossing section for connection to a crossing terminal of the battery.

29. The semi-permanent hearing device of claim 1, further including manually adjustable control means for adjusting at least one electro acoustic parameter of the device.

30. The semi-permanent hearing device of claim 29, wherein the manually adjustable control means includes at least one electrical jumper for enabling the adjustment.

It is certified that error appears in the above-identified patent and that said Letters Patent is hereby corrected as shown below:

Column 18 (cont'd),

31. The semi-permanent hearing device of claim 1, including programming means for selectively adjusting electro acoustic parameters of the device.

32. The semi-permanent hearing device of claim 31, wherein the programming means includes a programmer external to the device and adjustment means internal to the device responsive to programming signals from the programmer for performing the selective adjustment.

33. The semi-permanent hearing device of claim 32, wherein the programmer includes an electrical cable for connection to the device for delivering the programming signals to the internal adjustment means.

34. The semi-permanent hearing device of claim 32, wherein the programmer and the internal adjustment means include means for remote programming of the device by delivery of the programming signals without a physical connection there between.

35. The semi-permanent hearing device of claim 34, wherein the remote programming means includes means for transmitting and receiving at least one of sound, ultrasound, magnetic, electromagnetic, radio frequency and infrared signals as the programming signals.

36. The semi-permanent hearing device of claim 1, including measuring means for performing in-situ probe tube measurements of parameters of the device.

37. The semi-permanent hearing device of claim 1, wherein at least a portion of the sealing retainer comprises polyurethane, polyurethane foam or silicone.

38. The semi-permanent hearing device of claim 1, wherein the sealing retainer is removable or removable and disposable for replacement thereof.

39. The semi-permanent hearing device of claim 4, wherein the cavity is positioned in the sealing retainer coaxially with an axis to substantially coincide with the longitudinal axis of the ear canal in the bony portion thereof when the device is fully inserted It is certified that error appears in the above-identified patent and that said Letters Patent is hereby corrected as shown below:

Column 18 (cont'd), into the ear canal, whereby to support the receiver assembly along the longitudinal axis in the vicinity of the tympanic membrane of the wearer.

40. The semi-permanent hearing device of claim 4, wherein the cavity is medially shaped to conform at least partially to the battery assembly for acceptance thereof.

41. The semi-permanent hearing device of claim 1, wherein the sealing retainer is configured to provide sufficient acoustic sealing within the bony portion of the ear canal to substantially prevent the acoustic signals emanating from the receiver from feeding back to the microphone.

42. The semi-permanent hearing device of claim 1, wherein the sealing retainer is selectable from among an assortment of sealing retainers of different sizes and shapes supplied with the hearing device to accommodate the dimensions of the ear canal of the individual wearer.

43. The semi-permanent hearing device of claim 1, wherein the battery is a button cell type battery.

44. The semi-permanent hearing device of claim 2, wherein the battery is removable from the thin enclosure.

45. The semi-permanent hearing device of claim 2, wherein the battery assembly is removable from the device 46. The semi-permanent hearing device of claim 1, wherein the receiver assembly protrudes medially beyond the sealing retainer.

47. The semi-permanent hearing device of claim 1, wherein the connector has a varying flexibility along a length of the connector.

48. A semi-permanent hearing device configured to be inserted entirely within a wearer's ear canal past the canal aperture for long-term use therein, the device comprising:

It is certified that error appears in the above-identified patent and that said Letters Patent is hereby corrected as shown below:

Column 18 (cont'd), a sealing retainer configured to be seated in a bony portion of the ear canal along the longitudinal axis and in direct contact with walls of the ear canal when the device is fully inserted within the canal, the sealing retainer being conformable to the shape of the canal;

a receiver assembly configured to mate with the sealing retainer for positioning in a bony portion of the canal, the receiver assembly including a receiver for supplying acoustic signals processed by the device to a tympanic membrane of the wearer;

a microphone assembly including a microphone configured to receive incoming acoustic signals for processing by the device, the microphone assembly sized to be substantially non-occluding of a cartilaginous portion of the canal;

a flexible connector flexibly coupling the receiver assembly and the microphone assembly, the connector configured to flexibly support the microphone assembly in the cartilaginous portion of the canal so as to have a void space between a substantial portion of a microphone assembly perimeter and the walls of the cartilaginous portion; and a battery assembly coupled to at least one of the flexible connector, the receiver assembly and the microphone assembly, the battery assembly including a battery for powering the device.

49. A semi-permanent hearing device configured to be inserted entirely within a wearer's ear canal past the canal aperture for long-term use therein, the device comprising:

a sealing retainer configured to be seated in a bony portion of the ear canal along the longitudinal axis and in direct contact with walls of the ear canal when the device is fully inserted within the canal, the sealing retainer being conformable to the shape of the canal;

a receiver assembly configured to mate with the sealing retainer for positioning in a bony portion of the canal, the receiver assembly including a receiver for supplying acoustic signals processed by the device to a tympanic membrane of the wearer;

UNITED STATES PATENT AND TRADEMARK OFFICE

CERTIFICATE OF CORRECTION

PATENT NO. : 6,940,988 B1
DATED : September 6, 2005
INVENTOR(S) : Shennib et al.

It is certified that error appears in the above-identified patent and that said Letters Patent is hereby corrected as shown below:

Column 18 (cont'd), a microphone assembly including a microphone configured to receive incoming acoustic signals for processing by the device, the microphone assembly sized to be substantially non-occluding of a cartilaginous portion of the canal;

a flexible connector flexibly coupling the receiver assembly and the microphone assembly, the connector configured to flexibly support the microphone assembly in the cartilaginous portion of the canal and allow freedom of movement of the microphone assembly across a cross section of the ear canal in response to an applied force, the connector having a varying flexibility across a portion of the connector; and a battery assembly coupled to at least one of the flexible connector, the receiver assembly and the microphone assembly, the battery assembly including a battery for powering the device.

Signed and Sealed this

Twenty-eighth Day of March, 2006

JON W. DUDAS
*Director of the United States Patent and Trademark Office*